United States Patent [19]

Landis et al.

[11] 4,240,346

[45] Dec. 23, 1980

[54] WEB PRINTING PRESS

[75] Inventors: Earl M. Landis, Sagamore Hills, Ohio; Webster C. Roberts, Noank; James N. Crum, Stonington, both of Conn.

[73] Assignee: Harris Corporation, Cleveland, Ohio

[21] Appl. No.: 7,213

[22] Filed: Jan. 29, 1979

Related U.S. Application Data

[63] Continuation of Ser. No. 780,320, Mar. 23, 1977, abandoned.

[51] Int. Cl.[3] ..... B41F 7/04; B41F 7/12; B41F 7/40; B41F 13/36; B41F 31/30; B41F 13/54

[52] U.S. Cl. ..... 101/139; 101/143; 101/148; 101/177; 101/180; 101/181; 101/182; 101/225; 101/351; 271/5

[58] Field of Search ..... 101/177, 178, 179, 180, 101/181, 182, 183, 184, 185, 221, 136, 137, 138, 139, 142, 143, 144, 148, 225, 352, 351, 247; 271/4, 5, 1, 10, 20

[56] References Cited

U.S. PATENT DOCUMENTS

| | | | |
|---|---|---|---|
| 1,654,058 | 12/1927 | Smith | 101/221 |
| 2,149,028 | 2/1939 | Meisel | 101/181 |
| 2,859,691 | 11/1958 | Heller | 101/221 X |
| 3,139,025 | 6/1964 | Chambon | 101/182 X |
| 3,221,651 | 12/1965 | Tagliasacchi | 101/183 |
| 3,527,164 | 9/1970 | Bulk | 101/184 X |
| 3,527,165 | 9/1970 | Harless | 101/143 |
| 3,664,261 | 5/1972 | Dahlgren | 101/184 X |

*Primary Examiner*—J. Reed Fisher

[57] ABSTRACT

An offset lithographic web printing press capable of printing a series of relatively short runs without interruption and with minimum waste of web material. The press includes a plurality of printing units. During a given run, some of the printing units are in a printing mode, while others are in a nonprinting or thrown-off mode. The web moves freely through the units which are thrown-off while those units are made ready for a succeeding run. Each unit includes a motor which has adequate capacity to drive such auxiliary equipment as a web infeed and folder, in addition to the unit, itself. Each unit motor may be clutched into a common drive line passing through all the units in order to drive the infeed and folder. Each printing unit also includes apparatus for throwing the printing cylinders of the unit to and from the web, and for changing the attitude of the web as it passes through the unit. A control system is included which controls the throw-off of the engaged printing units at the end of a preset count and also controls start-up of the units which are to be engaged in the next run. The control system includes a circuit for selecting the printing mode of the units so that any one or all of the printing units may be used for printing a given job.

18 Claims, 11 Drawing Figures

AUTO PRINT FUNCTION CONTROLS

WEB PRINTING PRESS

This is a continuation, of application Ser. No. 780,320 filed Mar. 23, 1977, now abandoned.

BACKGROUND AND SUMMARY OF THE INVENTION

The present invention relates to a web printing press, and more particularly to a web printing press which is adapted for continuously printing a series of different jobs or runs. In the printing of short runs, it is desirable to effect a change from one run to the next quickly without "down time" and with a minimum loss of web material.

With respect to printing presses generally, the prior art has provided apparatus such as that shown in U.S. Pat. No. 3,139,025 to Chambon. The Chambon patent discloses direct printing apparatus in which runs of different printed context may be made by a series of rotary printers located along the path of a web and adapted to be alternately operated. While a first printing set is printing on the web, the second printing set may be made ready for the next run and after reaching a predetermined count, the first printing set is thrown off and the second printing set engaged with no loss of paper occasioned by the shift from the first printing set to the second printing set. Also as is well known, printing presses have been automated and control systems have been associated with presses to control the various printing units as desired by the press operator. Typical of patents which disclose such is U.S. Pat. No. 3,467,007.

The present invention relates to a web printing press which includes multiple printing units, a web infeed, a folder and other apparatus, such as chill rolls, etc. Specifically, the web printing press is a blanket to blanket offset lithographic press designed for printing short runs. In accordance with the present invention, a web may be moved through a unit or units which are in a printing mode, i.e. thrown-on, and a unit or units which are not in a printing mode, i.e. thrown-off. The units which are thrown-off may be made ready for the next job, while the other unit or unis are printing a different job.

A control system functions to control throw-on of the dampeners and inker of each unit as well as the blanket cylinder of each unit at the appropriate time so that a minimum of web material is wasted, i.e. where one job stops the next job starts. The control system is such that an operator may control the units so that any one or all of the units may print one job.

More specifically, the web press of the present invention utilizes individual motors associated with each printing unit. These motors are large enough to power the entire web press including both the printing units and the auxiliary units. A common drive line extends through the press and a single position clutch is associated with each unit and coacts between the common drive line and the motor for its unit. Upon engagement of a clutch, the motor of that printing unit is drivingly connected to the common drive line. Upon disengagement of a clutch the unit may be driven independently of the other units on the press for "make ready" purposes, and for bringing the printing unit up to a predetermined speed and into a predetermined condition prior to throw-on of the unit.

The present invention provides, therefore, a web press system which is especially suited to short runs of different printed matter and characterized by rapid changeover from one run to the next run with minimum loss of time and paper. While one printing unit is printing on the web, a second printing unit may be made-ready while the web continues to move through both of the units.

The present invention also provides a novel press driving arrangement including a main drive shaft and clutch means coacting between the shaft and a free running shaft ring gear which is driven from a power shaft connected to the individual printing unit motors.

Further, the present invention is embodied in a web offset lithographic press wherein each printing unit includes a cylinder system for offset printing including a pair of plate cylinders and a pair of blanket cylinders which desirably engage the web in an S-wrap configuration and print on both sides of the web simultaneously. Means are provided for selectively throwing-off each printing unit and for changing the path of the web as it passes between the thrown-off blanket rolls. This is done so that the web is restrained from flutter and contact with the thrown-off blanket cylinders as it passes the nonprinting unit. Lever arm supported grator rolls coacting above and below the web adjacent to and on opposite sides of the nip of the blanket cylinders are provided to change the attitude of the web as it traverses the nip. The grator rolls are driven up to the speed of the web prior to engaging the web.

BRIEF DESCRIPTION OF THE DRAWINGS

The invention may be better understood by having reference to the annexed drawings wherein.

DESCRIPTION OF PREFERRED EMBODIMENT

Figure 1:
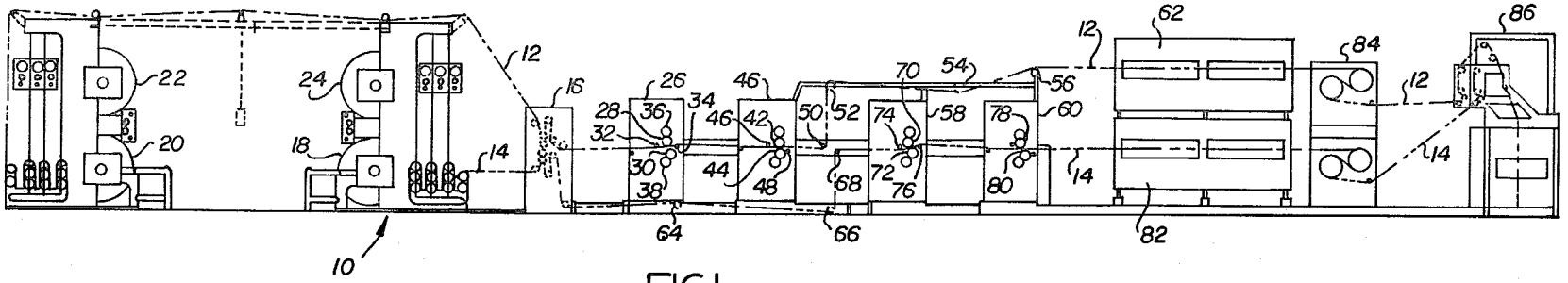
FIG. 1 is a schematic general layout in side elevation of a web offset press in accordance with the present invention.
Figure 2:
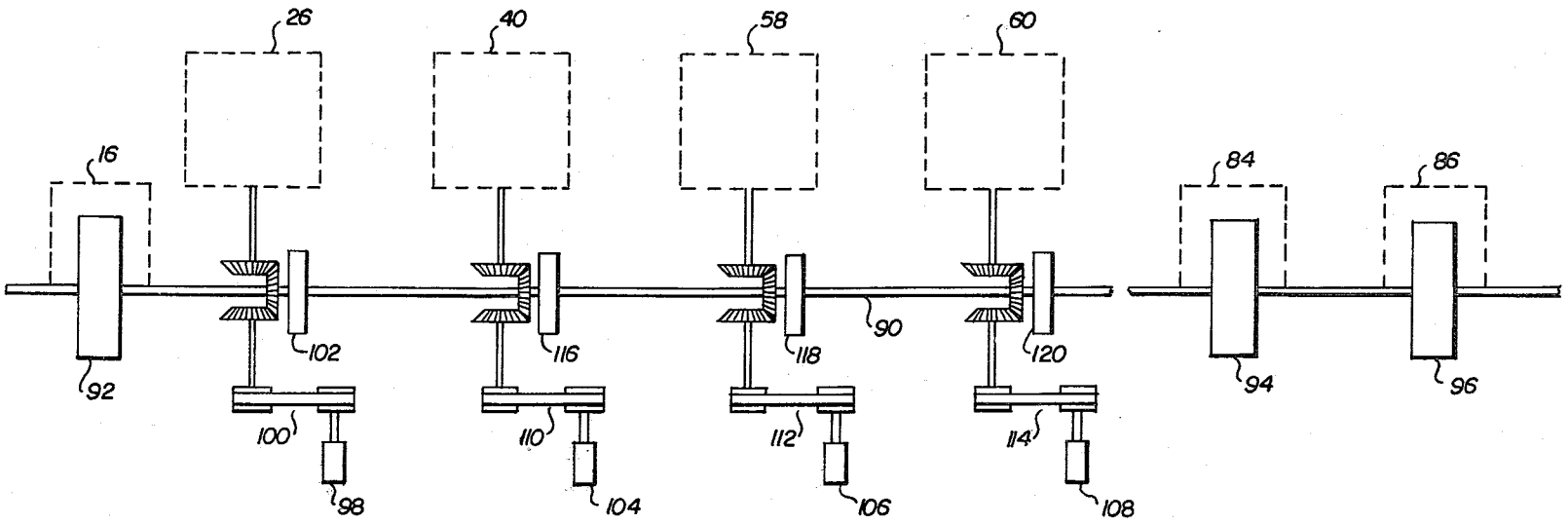
FIG. 2 is a diagrammatic and schematic layout of a main drive system for powering the various units of the web offset press shown in FIG. 1.

FIG. 1 shows schematically in side elevation the general arrangement of a web offset press embodying the present invention. FIG. 2 is a schematic view of a common or main drive shaft showing the arrangement of the individual motors and clutches for the various press units and the auxiliary units.

In general, a web offset press in accordance with the present invention includes web supply reels, a splicer or pasting unit, for joining the leading edge of a fresh paper roll to the trailing ends of a spent roll, a plurality of selectively engageable and disengageable web printing units for printing one or both sides of a web, a web drying unit, a cooling unit including chill rolls and a folding unit. Depending upon the nature of the work being done on the web offset press one or more of the auxiliary units may be selectively disabled for a given run. The auxiliary units are conventional and their use and operation is well known. The printing units are generally utilized in pairs as a printing set and there may thus be a plurality of such pairs. In a succession of printing units, one printing unit is usually in a printing mode, i.e., thrown-on and the next printing unit is in a nonprinting mode, i.e., thrown-off with a gap formed between the printing cylinders and being, for example, in a "make-ready" condition for a succeeding run. When a printing unit is thrown off, the web nevertheless continues to pass through the press unit at printing speed.

A common drive shaft extends parallel to the web offset press and is carried by suitable journals and has suitable power transmitting points opposite each of the press units. Each individual printing unit has a motor capable of driving not only its printing unit, but also the remaining driven press units, e.g. the operating auxiliary units requiring power through the common drive shaft. Single position clutch means provide proper timing of the units and enable selective engagement and disengagement of the individual press units from the drive shaft. The motor of at least one printing unit is at all times engaged in driving relation to the common drive shaft during a run.

The individual offset printing units include much that is conventional. For example, the inking system and the damping system for the plate cylinders are conventional and their operation is well known and will not be described.

Referring now more particularly to FIG. 1, there is shown a complete web offset press. Proceeding from left to right in the direction of movement of the web, there is first shown a web supply system generally indicated at 10. In the arrangement shown, a pair of webs 12 and 14 are fed to an infeed unit 16. Supply rolls 18 and 20 are on stream and supply rolls 22 and 24 are on standby for subsequent splicing and putting on stream. The supply reels and pasting system are conventional and any available such system may be used.

Web 12 next enters a printing unit 26 which in FIG. 1 is shown in a thrown-off mode wherein the web 12 passes between blanket cylinders 28 and 30 which have been moved to a thrown-off position by a throw-off mechanism hereinafter more particularly described. The attitude of the web 12 has also been shifted slightly by grator rolls 32 and 34 to be more nearly perpendicular to a plane extending through the axes of blanket cylinders 28 and 30. Grator rolls 32 and 34 also aid in preventing flutter in web 12 by shortening the free span of the web and thus to prevent contact with the thrown-off blanket cylinders 28 and 30. Plate cylinders 36 and 38 run in contact with blanket cylinders 28 and 30 in a known manner. Conventional inker and damper systems, not shown, are utilized in conjunction with the plate cylinders.

Web 12 exiting from printing unit 26 next enters printing unit 40 which may be of identical structure to printing unit 26. Printing unit 40 is shown in a printing mode and web 12 is in contact with blanket cylinders 42 and 44 following a known S-wrap configuration on traversing the nip between the cylinders 42 and 44. Grator rolls 46 and 48 have been located out of contact with web 12 to allow the attitude of the web 12 to assume an S-wrap profile for receipt of offset print from blanket cylinders 42 and 44.

Web 12 upon leaving printing unit 40 is turned about turning rolls 50 and 52, and control rolls 54 and 56 for by-passing printing units 58 and 60 and introduction into upper drying unit 62. In the meantime, web 14 proceeds from the infeed unit 16, over web control roll 64 and turning rolls 66 and 68 for entry into printing unit 58.

Printing unit 58 is in a nonprinting mode, the blanket cylinders 70 and 72 having been thrown-off and spaced from the web 14. Grator rolls 74 and 76 function in printing unit 58 in the same manner as they do in printing units 26 and 40. Printing unit 60 is next encountered by the web 14 and is in a printing mode in the same manner as printing unit 40 is shown with respect to web 12. Thus, blanket cylinders 78 and 80 are printing web 14. Web 14 on leaving the printing unit 60 enters lower drying unit 82.

Following the dryer units 62 and 82, webs 12 and 14 enter a chill roll unit generally indicated at 84. The dryer and chill roll units are of known structure and operation. Finally, webs 12 and 14, which have been printed on both sides, dried and cooled, enter a folder unit generally indicated at 86 where signatures are formed from sheets cut from webs 12 and 14. Folder unit 86 is also of known structure and operation.

Printing units 26, 40, 58 and 60 are desirably, although not essentially, of like structure and operation. In a given run and as illustrated in FIG. 1, printing units 26 and 58 are thrown-off and may be undergoing "make-ready" procedures while webs 12 and 14, respectively, pass through these units out of contact with the offset printing cylinders. Printing units 40 and 60 constitute a first printing set herein and are shown in a printing mode moving toward completion of a predetermined count of signatures constituting a run. Near the end of the run, controlled sequencing operations may be activated for bringing on stream the second printing set composed of printing units 26 and 28, and the throwing-off of the first printing set consisting of units 40 and 60. While the second printing set is operating toward the completion of its separate run, the first printing set is undergoing "make-ready" procedures for a third run. Thus, a succession of runs, usually of relatively short duration, may be made without shutting down the entire web offset press.

Referring now more particularly to FIG. 2, there is here shown in schematic and diagrammatic form a main drive line 90 which is positioned parallel to the auxiliary units, e.g. infeed unit 16, the chill roll unit 84 and the folder unit 86. Power to operate such of these units are required to be driven is provided through power take-off units. Thus, the power to operate the infeed unit 16 is transferred from the drive line 90 through power take-off unit 92. The power take-off unit 92 may include, if desired, a clutch to enable selective engagement and disengagement of this auxiliary unit.

In like manner, power for operation of other auxiliary units, e.g. the chill roll unit 84 and the folder unit 86 is provided through power take-off units 94 and 96, respectively. Clutches enabling selective engagement and disengagement of these auxiliary units 84 and 86 may be provided, if desired.

Figure 3:
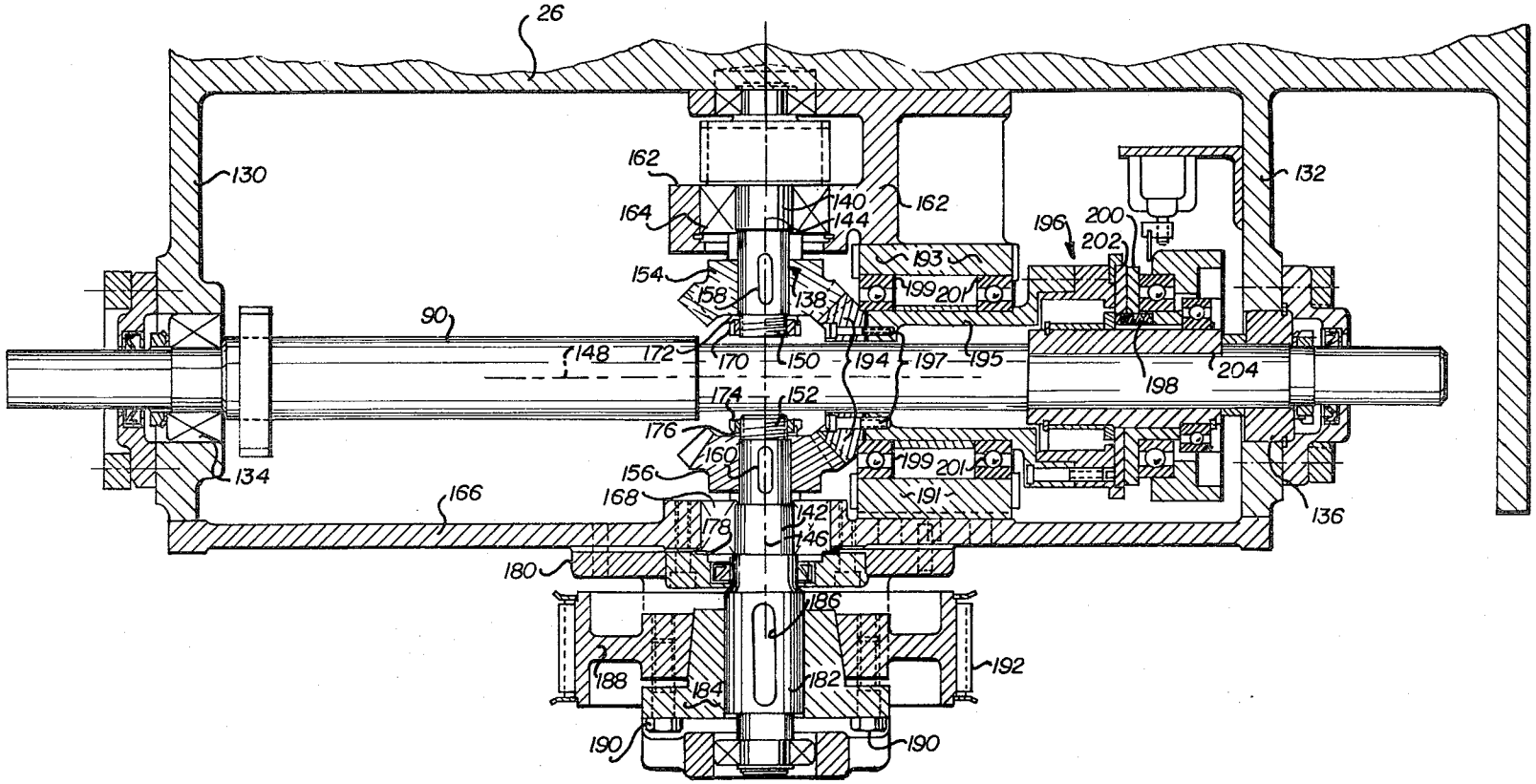
FIG. 3 is a plan view in cross-section of a drive arrangement between each printing unit and a common drive shaft.

As indicated above, each of the printing units is provided with a drive motor of sufficient capacity to drive an entire web offset press including a printing set and any auxiliary units. Thus, printing unit 26 is provided, as schematically and diagrammatically shown in FIG. 2 with a drive motor 98, a drive train 100 and a clutch 102, the details of which are best shown in FIG. 3. Drive motor 98 is of sufficient capacity to drive printing unit 28, infeed 16, chill rolls 84, folder 86 and to move the web 12 from the supply reel 20 through the entire press. It is also sufficient to drive the press unit 26 independently of the drive line 90 during "make-ready" procedures. In like manner, printing units 40, 58 and 60 are each provided with a separate drive motor, e.g. motors 104, 106 and 108, a drive train 110, 112 and 114, respectively, geared for driving relation with the respective printing units 40, 58 and 60, and selectively engageable with drive line 90 through associated clutches 116, 118 and 120.

The drive line 90 is suitably supported in frame members and bearings for rotation as will be indicated below. The main drive line may be a single shaft, or a series of shafts coupled together through universal joints.

The clutches 102, 116, 118 and 120 are of known structure, and are characterized in that they are shaft mounted, single position, air actuated, tooth clutches. Reference may be had to U.S. Pat. No. 3,760,916 for details of the clutch mechanism. Any other shaft mounted, single position clutch may be employed in the web offset press thereof.

The power transfer units coacting between the individual printing units and the main drive line operate to transfer power from the drive motor associated with the printing unit to the drive line for running the entire press, or to tranfer power from the main drive line to the individual printing unit in a given printing set. The clutch mechanism enables the printing units, e.g. those which are thrown off, when disengaged to be driven by their respective motors during "make-ready" procedures.

A section of the main drive line 90 is shown in FIG. 3 extending through opposing frame members 130 and 132 of a printing unit. e.g. printing unit 26. Drive line section 90 is journaled for rotation in the frame members 130 and 132 by roller bearings 134 and 136, respectively. Conventional retaining and sealing means are employed at each bearing.

A split transaxle 138 consisting of a press drive shaft section 140 and an input shaft section 142 are provided preferably having their respective axes 144 and 146 lying in the same plane as the axis 148 of shaft 90 and extending transverse thereto. Ends 150 and 152 of shaft sections 140 and 142, respectively, are fitted with bevel pinion gears 154 and 156, respectively, suitably keyed to the shaft sections 140, 142 by keys 158, 160, respectively. The press drive shaft section 140 is journaled for rotation in a frame connected bracket 162 by a roller bearing 164, and input shaft section 142 is journaled for rotation in the frame member 166 by a roller bearing 168. Bevel pinion gear 154 is held on the end of shaft section 140 by nut 170 suitably locked against loosening by lock washer 172. In like manner, bevel pinion gear 156 is held on the end of input shaft section 142 by nut 174 and lock washer 176. Roller bearing 168 is held in position in the frame member 166 by any suitable means, for example, as shown in a snap ring 178 and retainer 180.

The outer end 182 of the input shaft 142 is provided with a tapered hub 184 keyed to the outer end 182 by key 186. A complementarily tapered pulley 188 is tightly held on the hub 184 by suitable fasteners, e.g. bolts 190. The pulley 188 is driven by a belt 192 or a series of V-belts from a drive motor for the unit not shown in FIG. 3. As indicated, the drive motor has sufficient capacity to run the entire web offset press.

To transmit power from the drive bevel pinion gear 156 to the press driven pinion bevel gear 154, there is provided a ring bevel gear 194 through which the main drive line 90 passes freely and which ring bevel gear 194 is meshed with bevel gears 154 and 156. Power is transmitted from the motor directly to the printing unit through the transmission above described.

To enable power also to be transmitted to the main drive line 90, there is provided a shaft mounted single position fluid operated clutch generally indicated at 196. Reference may be had to U.S. Pat. No. 3,760,916. In general, the clutch consists of three parts, a first portion keyed to the main drive line 90, a second portion attached to the ring gear 194, and an axially movable third portion which selectively locks the first and second portions together. Fluid pressure, e.g. air pressure, effects movement of the third portion into an engaged position where power is transmitted from the motor to the input drive bevel pinion 156 through the ring gear 194 to both the printing unit driven bevel gear 154 and through the clutch unit 196 to the main drive line 90. Thus, the individual printing unit is driven as well as all other units operatively connected to the drive line 90. When the fluid pressure is released, springs, e.g. spring 198, return the clutch plate 200 to a disengaged position whereby ring gear 194 is declutched and runs freely about the main drive line 90.

The clutch 196 is a single position clutch so that synchronism can be maintained among the various printing units in a printing set and among the printing set and the auxiliary units of the web offset press. The details of operation of such a clutch are found in the aforesaid U.S. Pat. No. 3,760,916. In general, the clutch faces 200 and 202 are provided with radiating gear teeth which interlock for driving engagement, but not until three driving detents or balls are properly aligned with corresponding grooves in plate 200. The positioning of the balls and grooves is such that the driving engagement can occur in only a single angular relationship between the clutch faces 200 and 202. The clutch 196 is keyed to the main drive line 90 by a key 204.

In the installation of the clutch 196, the declutching portion 195 to which ring gear 194 is bolted as by bolts 197, is mounted for rotation in axially spaced frame supported ball bearings 199 and 201. Frame portions 191 and 193 support ball bearings 199 and 201 so that the declutching portion 195 is supported by the frame concentric with but separated from the main drive line 90. Should the clutch structure shown in U.S. Pat. No. 3,760,916 be used without the foregoing modification for mounting the declutching section 195, unpredictable seizure of the declutching portion bearings could engage the printing unit with the main drive line 90 thus posing the danger of injury to the operator.

Figure 4:
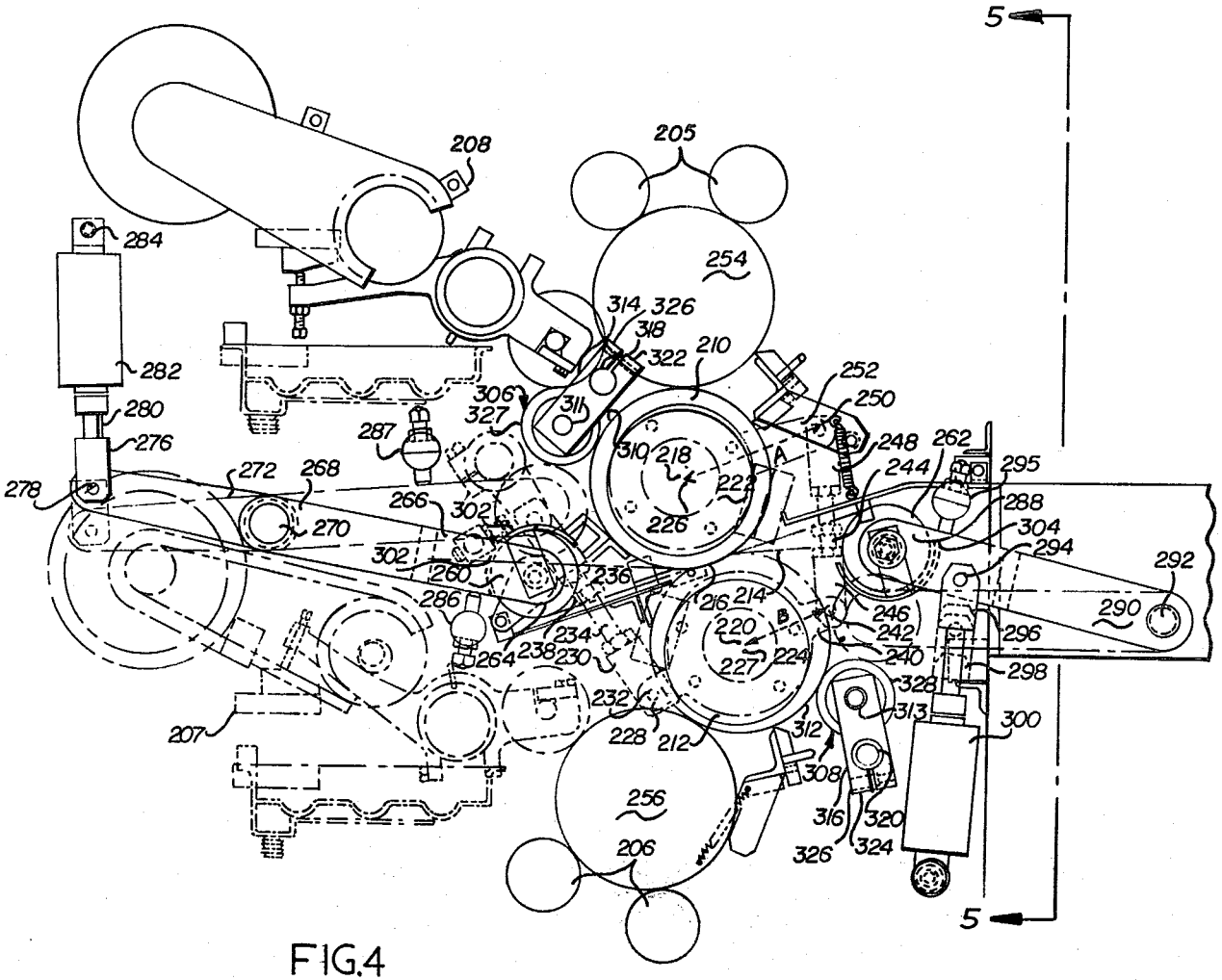
FIG. 4 is a view showing the cylinders of a printing unit, and particularly the means for throwing-off the blanket cylinders and changing the path of the web.

FIG. 4 shows in partial side elevation one of the printing units. The unit includes an inker system with ink forms 205 and 206 and a dampening system indicated generally at 207 and 208. These systems will not be dealt with further since they are of known structure and operation and unnecessary to a full understanding of the present throw-off system. A feature of the web offset presses of this invention is the structure for throwing-off a printing unit for make-ready purposes for a succeeding run while the web is still passing through the printing unit. As indicated, the printing units of the present invention are of the offset type utilizing a pair of web engaging blanket cylinders, one blanket cylinder acting as an impression cylinder for the other and simultaneously printing both sides of the web. The web as it passes through the nip between the blanket cylinders follows what is known in the art as an "S-wrap" configuration. The arrangement of the blanket cylinders and the web infeed means which result in an S-wrap and the advantages of such are known. The present invention provides apparatus for changing the attitude at which the web enters the nip from one providing the S-wrap configuration for printing purposes to one which enables the web to pass between the thrown-off spaced blanket cylinders along a path which is generally normal to a plane including the axes of rotation of the blanket cylinders. This change in the attitude of the web is effected by controlled movement of grator rolls. The grator rolls move between a first position in contact with the web in a thrown-off condition and a second position out of contact with the web in an on-line or printing condition. To prevent damage to the web when the grator rolls are in the process of contacting the web, means are provided to drive these rolls before contact with the web.

Figure 5:
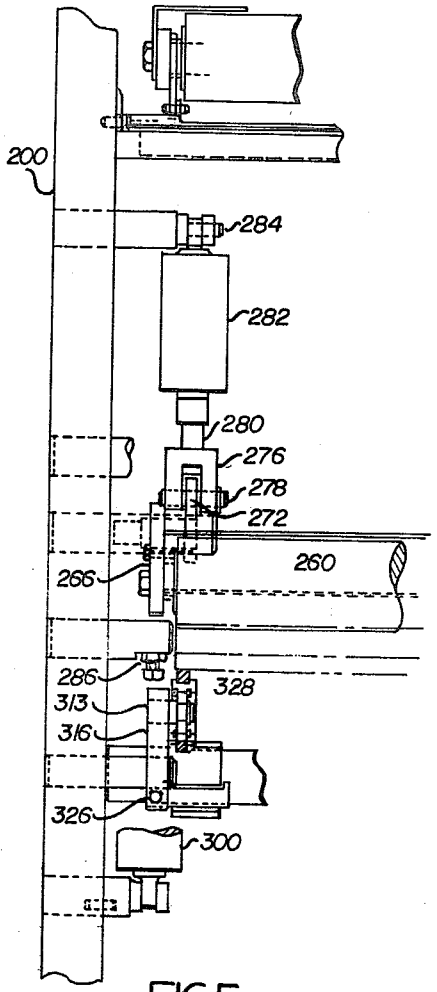
FIG. 5 is a partial end elevation of a printing unit in accordance herewith showing the web path changing means as they appear in the plane indicated by the line 5—5 in FIG. 4.

With more particular reference to FIGS. 4 and 5, there is shown an upper blanket cylinder 210 and a lower blanket cylinder 212 in on line printing relation. The web 214 enters the nip 216 nontangentially to the cylinders at an angle other than 90 degrees to a plane including the axes 218 and 220 of blanket cylinders 210 and 212. This disposition of the web 214 and its exit from the cylinders 210 and 212 provides the S-wrap profile above referred to. The web 214 as it leaves the nip 216 lies in a plane different from the plane in which it entered the nip 216, and preferably a plane parallel to and above the plane of entry.

The blanket cylinders 210 and 212 are mounted interiorly of the printing unit frame for rotation about their respective axes 218 and 220 in eccentrics 222 and 224 which are mounted for limited rotation in the frame of the press about axes 226 and 227. To rotate the eccentrics, and change the relative location of the blanket cylinder axes 218 and 220, the eccentrics are provided with an arm and linkage system mounted outside the frame. The eccentric 224 is provided with a first arm 228 pivotally connected to a clevis 230 by a pin 232. The clevis 230 is at the distal extremity of an extensible and retractable arm 234 projecting from a fluid operated actuating cylinder 236. The arm is provided with an adjustable stop 238 for limiting the extent of travel of the arm 234.

Diametrically opposite the first eccentric arm 228 is a second eccentric arm 240 which is pivotally secured by a pin 242 to a linkage 244 through a clevis 246. The opposite end of the linkage 244 is provided with a second clevis 248 which is pivotally connected by a pin 250 to an upper eccentric arm 252. The length of the linkage 244 is desirably adjustable for controlling the extent of throw-off.

The length of the arm 252 indicated by A is greater than the length of arm 240 indicated by B. Hence, a 0.375" movement, for example, of pin 242 at a distance B from eccentric center 227 and causing an angular rotation (b) of eccentric 224 will translate into a 0.375" movement of arm 252 at a distance A from eccentric center 226 causing a smaller angular rotation (a) of eccentric 222.

While in prior art devices the act of throwing-off the blanket cylinders resulted in each cylinder moving the same distance out and away from the nip 216 (see U.S. Pat. No. 3,527,165 to Harless and 3,724,368 to Treff), in the present device, the upper blanket cylinder moves forward (to the right as shown in FIG. 4) and generally toward the plane of the nip 216. However, at the same time, the lower blanket cylinder 212 moves forward and away from the nip 216 a greater distance than the upper blanket cylinder 210 moves toward the nip. Hence, the cylinders 210 and 212 are spaced apart in a thrown-off mode with the midpoint of a line joining the axes 218 and 220 being translated downwardly and forward of its location when the cylinders are thrown-on, i.e. in an on line or printing relation to the web.

The foregoing throw-off mechanism also throws the blanket cylinders 210 and 212 off with respect to their coacting plate cylinders 254 and 256, respectively, being in this respect not unlike prior art throw off mechanisms.

As indicated above, when in the printing mode, the web follows a path indicated by the number 214 in an S-wrap configuration through the nip 216. Because the web is intended to be continuously running in the web offset press, and because of the movement of the upper blanket cylinder 210 in the throw-off action, the attitude of the web 214 must be changed. Moreover, the web must be supported at positions relatively close to the open nip 216 to prevent flutter which would allow the web to contact one or both blanket cylinders in traversing the open nip (when thrown-off). To protect the printed web and assure that it is not marked or broken by any contact with the blanket cylinders 210 and 212 in a silenced, or thrown-off printing unit, guide rollers 260 and 262 are provided and are located in the path 214 of the web in a manner to change the attitude of the web and guide it through the nip 216, and to shorten the free span of the web and thus limit the envelope of web flutter. For most efficient passage of the web through the gap between the blanket cylinders 210 and 212 when "off-pressure" the web should preferably pass through such gap in an attitude perpendicular to a line joining the centers of the thrown-off cylinders.

To accomplish the foregoing web control, there is provided a web infeed control roll or grator roll 260 and a web outfeed control roll or grator roll 262. Web control roll 260 spans the web and is journaled for rotation at the distal extremity 264 of a roll control arm 266. Control arm 266 is secured at its proximal extremity to a shaft 270 for rotation therewith. Shaft 270 extends between the front and rear frame portions (not shown) and is journaled for rotation therein. An operating arm 272 is secured also to the shaft 270, preferably on the outside of the front frame member (not shown), and at its free end 274 pivotally connected to a clevis 276 by a pin 278. The clevis 276 is in turn secured to the free end of extensible arm 280 which is actuated by a fluid operated cylinder 282. The cylinder 282 is secured to the printing unit frame (not shown) by any suitable means e.g. pin 284. Thus, it will be seen that as the arm 280 is extended out of cylinder 282 under the influence of pressurized fluid, e.g. air pressure, the arm 266 carrying roller 260 is moved from its solid line position in FIG. 4 to the position shown in dotted lines. In the latter position, the roll 260 is out of contact with the web.

The extent of travel of the arm 266 is limited by a first adjustable stop 286 when engaging the web, and by a second adjustable stop 287 when in the off-web position.

In like manner, an outfeed web control roll 262 is provided and journaled for rotation in the distal end 288 of arm 290. The arm 290 is mounted for rotation on the shaft or stud 292, the latter being secured in the frame member 200 (FIG. 5). The arm 290 is connected by a pin 294 to a clevis 296 at the end of an extensible arm 298 actuated by a fluid cylinder 300. In this case, a single adjustable stop 295 limits travel of the web control roll 262 into the web engaging position.

The rolls 260 and 262 are conveniently provided with protective shrouds 302 and 304, respectively.

In utilizing the web guide or control rolls 260 and 262, it is necessary that when being brought into contact with the web 214 to change its attitude relative to the nip 216 as occurs when taking the printing unit off impression (throwing-off) the guide roll surface velocity should be substantially the same as that of the web 214. If this were not true, a web break could result.

In order to achieve speed matching simply, the guide rolls 260 and 262 are driven by friction rollers 306 and 308, respectively, which in turn are frictionally driven by bearers 310 and 312 at the extremitites of the blanket cylinders 210 and 212. Friction rollers 306 and 308 are each mounted in bearings on studs 311 and 313 carried on arms 314 and 316, respectively. The arms 314 and 316 are mounted in turn on studs 318 and 320 at the respective opposite split ends 322 and 324 and clamped thereto by threaded screws 326. The clamping means at ends 322 and 324 permit adjustment of the rollers 306 and 308 in frictional contact with the bearers 310 and 312.

In the thrown-off positions shown in dotted lines in FIG. 4, the control rolls 260 and 262 are in contact with the rubber surfaces 327 and 328, respectively, and drive at a linear speed which substantially matches that of the web. When the rolls 260 and 262 are shifted into contact with the moving web 214 in preparation for throw-off of the blanket cylinders 210 and 212, their peripheral speed is close to that of the web 214, and the shift occurs rapidly enough that there is little loss in rotational speed.

CONTROL CIRCUITRY

Figure 6:
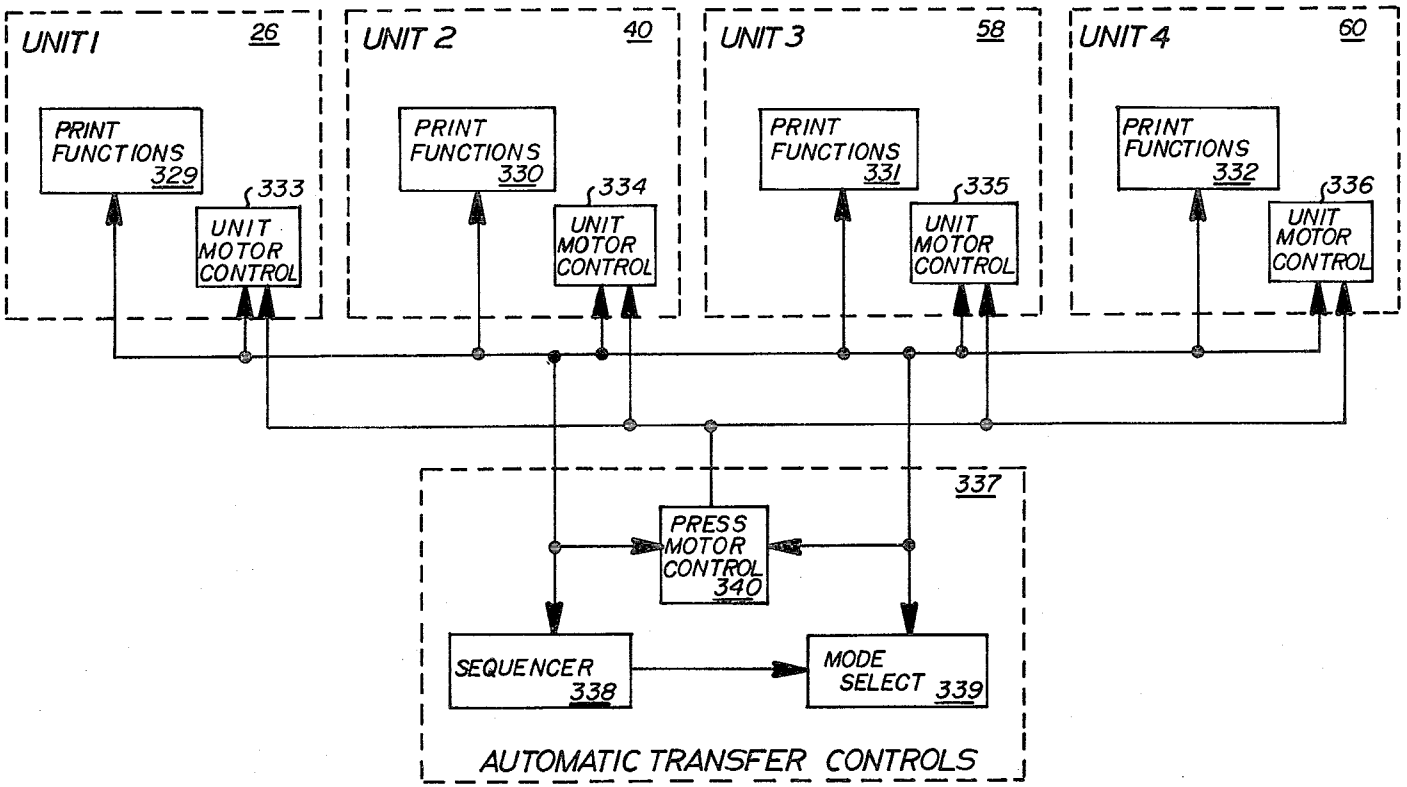
FIGS. 6–11 show control circuitry for the several printing units, and including circuitry for phasing in printing press operations which must be accomplished before a given printing unit is shifted from a nonprinting mode to a printing mode.

The circuitry which controls the several printing units is illustrated generally in FIG. 6. The four printing units 26, 40, 58, and 60, each include respective print function controls 329, 330, 331, and 332 which serve to control the print functions of the associated unit. These print functions include operation of waterpan motors, waterforms, inkforms, inkductor, and thrown-on and off of impression. In addition to these print function controls, each unit includes a respective unit motor control 333, 334, 335, 336 which controls the operation of the motor associated with the respective unit. The print function and unit motor controls of each of the units are interconnected with an automatic transfer control 337. Automatic transfer control 337 operates to automatically transfer operation at press run speed from one printing unit or printing set to an alternate printing unit or printing set. For example, if the first and third units 26 and 58 are operating and are nearing the end of a run, automatic transfer control 337 will operate to automatically bring the second and fourth units 40 and 60 up to speed, and sequentially activate the print functions associated therewith in the proper order. Thereafter, units 40 and 60 will be clutched into the drive line and units 26 and 58 will be taken off impression, declutched, and braked to a stop.

For changing one or more printing units from a printing mode to a nonprinting mode, automatic transfer control 337 includes a requencer 338 which serves to supply print function commands and motor control commands in common to the control circuits associated with each of the units. These commands will produce the desired sequential operation of the motors and print functions of the units being brought on line. The respective control circuits will either respond to, or ignore, the sequencer commands in accordance with unit selection signals supplied by a mode select circuit 339.

Through the circuitry which will now be described, unit 26 may be operated in an alternating fashion with unit 40, and unit 58 may be operated in an alternating fashion with unit 60. The operator will select the mode of operation by actuating appropriate controls located at each of the units. A "transfer" switch will be located at each unit. In order to select an alternating mode of operation, the transfer switches associated with all of the units involved in the alternating operation must all be actuated. Thus, for example, if units 26 and 58 are to be alternated with units 40 and 60, the transfer switches for all four units must be actuated. The operator will then clutch into the drive line 90 those units (e.g. units 26 and 58) which are to be operated initially. Signals from the clutch and transfer switches of each unit are communicated to the mode select circuit 339, which will recognize which mode of operation has been selected by the operator on the basis of these signals. The operator will also preset the length of the run into a manually settable counter located at the sequencer 338.

The press motor controls 340 will then be operated so as to place the press in a continuous run condition. After the press has been brought up to speed, the initial run will begin. Sequencer 338 will count the number of impressions provided by the press and will continually compare this number against the length of the run established by the operator in the sequencer 338. As the press approaches the end of the run, the sequencer 338 will automatically initiate the sequential operation of the print functions associated with the "new" units, i.e., 40 and 60 in this case. These units will then be brought on-line into the printing mode and the initially operating units (units 26 and 58) will drop off-line into the nonprinting mode.

At the conclusion of the automatic transfer, mode select circuit 339 will receive a signal from sequencer 338 indicating that the mode of operation of the press has been changed. Mode select circuit 339 will then change the mode select signals so that, as the end of the run of units 40 and 60 is approached, the signals supplied by sequencer 338 will now serve to control the print function controls associated with units 26 and 58, rather than those associated with units 40 and 60.

Figure 7:
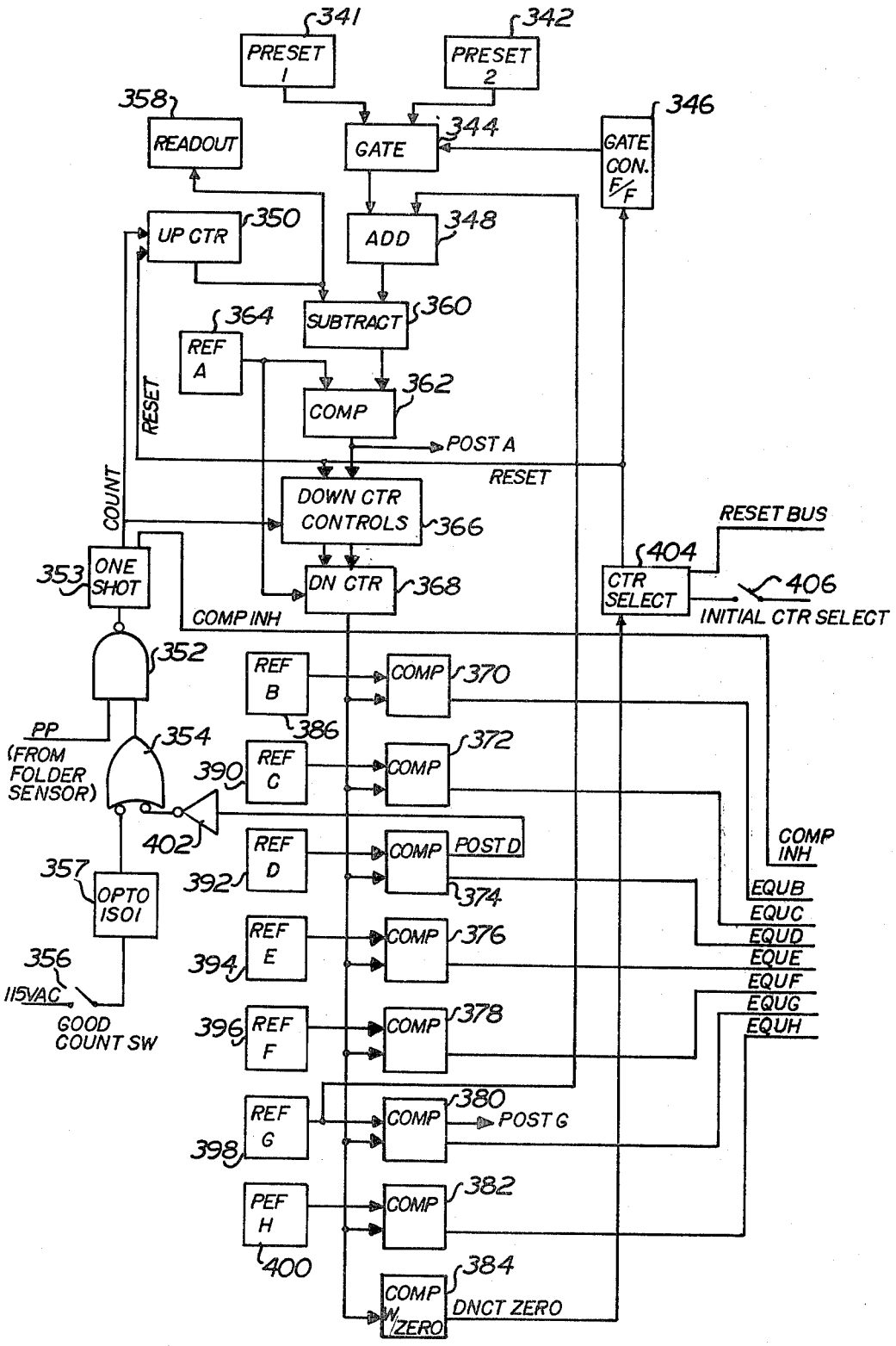

Referring now to FIG. 7, a more detailed diagram of sequencer 338 is shown. Two manually settable counters 341 and 342 are provided. These manually settable counters could comprise five-digit thumbwheel switches which each provide binary coded decimal (BCD) signals to a gate circuit 344. Gate circuit 344 will serve to selectively pass the BCD signals provided by either one or the other of the two preset counters in accordance with the state of a gate control flip-flop 346. The selected counter will then be presumed to contain the number indicating the length of the current run. In the described embodiment, the alternately operating units will be brought on-line into the printing mode at a selected point just prior to the conclusion of the currently operating run. Some overprinting will thus occur at that time. Consequently, the number of impressions to be produced in a given run must be increased by the number of overprints which will occur at the conclusion of the run. This is accomplished by an adder circuit 348 which serves to combine the output of gate circuit 344 with a signal supplied by a reference circuit which will be described hereinafter. The combined signal supplied by adder circuit 348 thus indicates the total number of impressions required of the current run.

A BCD up-counter 350 is provided for determining the number of good impressions which have been produced by the press in the current run. This is accomplished by counting the number of pulses produced by a sensor associated with the folder of the press. The folder sensor will be described further with reference to FIG. 11. The signals (PP) generated by the folder sensor are directed to a NAND gate 352 which will pass the signals to a one-shot circuit 353 whenever the output of a second NAND gate 354 is at a high logic level. A manually operable switch 356 is provided for allowing the operator to disable the passage of signals from the folder sensor to the up-counter 350 whenever the impressions being providing by the on-line printing unit are of bad quality. Switch 356 is isolated from the sequencer circuitry by an optical isolator 357. Unless switch 356 is closed, the output of optical isolator 357 will be high, thereby disabling NAND gate 352 through NAND gate 354.

A second input to NAND gate 354 is derived from the sequencer circuitry itself and is provided for bypassing the good-count switch whenever a certain point has been reached in the automatic transfer operation. Once this point has been reached, it is no longer possible to disable up-counter 350 from accumulating further counts until after the automatic transfer operation has been completed.

The output of up-counter 350 is directed to a read-out circuit 358 which provides a visual indication to the operator of the number of good impressions which have been produced in the current run. The output of up-counter 350 is additionally directed to a subtractor circuit 360 which serves to subtract this number from the number supplied by adder circuit 348 (indicating the total number of impressions which must be produced in the current run). The output of subtractor circuit 360 thus indicates the number of impressions which remain to be produced in the current run. This signal is directed to a comparator circuit 362 which compares this number against a reference number A supplied by a reference circuit 364. This reference number indicates the point in any run at which the automatic transfer operation should be initiated. Thus, when the number of impressions which remain to be produced is equal to the number supplied by reference number circuit 364, the output (Post A) of comparator circuit 362 will shift to a high logic level and will thus initiate the automatic transfer operation.

A down-counter control circuit 366 is provided which responds to the output of comparator 362 as well as to the count signal supplied by one-shot 353. Down-counter control circuit 366 serves to load a down-counter 368 with the reference number A (contained in reference number circuit 364) at appropriate times. Also, down-counter control circuit 366 serves to enable or disable the passage of the count pulses supplied by one-shot 353 to down-counter 368. Thus pulses, when gated to down-counter 368, will each decrement the number contained within down-counter 368 by one.

In its simplest form, down-counter control circuit 366 will simply pass the count pulses directly to the count input of down-counter 368 whenever the output of comparator circuit 366 has shifted to a high logic level, and will directly pass the reset signal to the load control input of down-counter 368 so as to reload the down-counter with reference number A whenever a reset pulse is generated. It may be desirable, however, to include operator controlled switches for the purpose of disabling the supply of count signals to down-counter circuit 368 under various circumstances. Because of this, down-counter control circuit 366 is merely illustrated in its general form.

When enabled by down-couner control circuit 366, down-counter 368 will proceed to count down from reference number A at the same rate at which good impressions are supplied by the press. Comparators 370–384 will compare the number generated by down-counter 368 against several successively smaller reference numbers. As the count-down proceeds, the output of comparators 370–384 will each indicate when coincidence between the count-down and the corresponding reference number has occurred. The reference numbers against which the down-count is compared are generated by a series of reference number circuits 386–400. These reference number circuits (identified in the FIGURE as supplying reference numbers B-H), as well as reference number circuit 364, may conveniently comprise thumbwheel switches similar to those used for counters 341 and 342. Comparator 384 does not have a reference number input, but rather serves to compare the down-count with zero.

Since comparators 370–384 serve only to determine when the down-count is equal to the corresponding reference number, and since down-counter 368 is being continually decremented by the count signal supplied by one-shot 353, the output of each comparator will take the form of a single pulse occurring at a selected time during the run and having a duration established by the length of time between successive count pulses supplied by one-shot 353. Since reference numbers B through H are sequentially smaller, the pulses generated by the comparators (EQUB through EQUH) will occur in sequence as the current run nears conclusion. These outputs are directed to the print function and unit motor controls of each unit and will produce the desired sequential operation thereof at the appropriate time during automatic transfer.

Comparators 374 and 380 additionally have second outputs (Post D and Post G, respectively) which indicate when the number supplied by down-counter 368 is smaller than the corresponding reference number. These additional outputs will shift to a high logic level when the down-count reaches the corresponding reference number, and will remain at a high logic level until down-counter 368 is reset to a value which is greater than the corresponding reference number.

The additional output of comparator 374 (Post D) is directed to NAND gate 354 through invertor 402. It is this output which serves to disable the good count switch 356 so as to prevent the operator from interfering with the automatic transfer operation once the down-count signal supplied by down-counter 358 has reached reference number D.

The additional output of comparator 380 (Post G) is directed to the motor control circuit for purposes which will be described in greater detail with respect thereto.

When the down-counter has been decremented to zero, the output of comparator 384 will shift to a high logic level. This will trigger a counter select circuit 404 to produce a reset pulses which will reset up-counter 350 and down-counter 368 (through control circuit 366) while toggeling gate control flip-flop 346 to a state at which the gate 344 will now pass the BCD signals generated by the alternate thumbwheel switch.

Counter select circuit 404 may conveniently comprise a one-shot circuit with associated gating circuitry so that the trigger input to the one-shot is responsive to three different signals. As described, the counter select circuit 404 will generate a reset pulse whenever the output of comparator 384 indicates that the down-count has reached zero (thereby indicating that the current run has concluded). Additionally, a reset pulse may be generated by triggering the one-shot through manual operation of an initial counter select switch 406. Each time switch 406 is depressed, a reset pulse will be generated which will cause the output of gate control flip flop 346 to change its output state. Through this operation the operator may select which of the counters 340 or 342 the sequencer will respond to initially.

Figure 8:
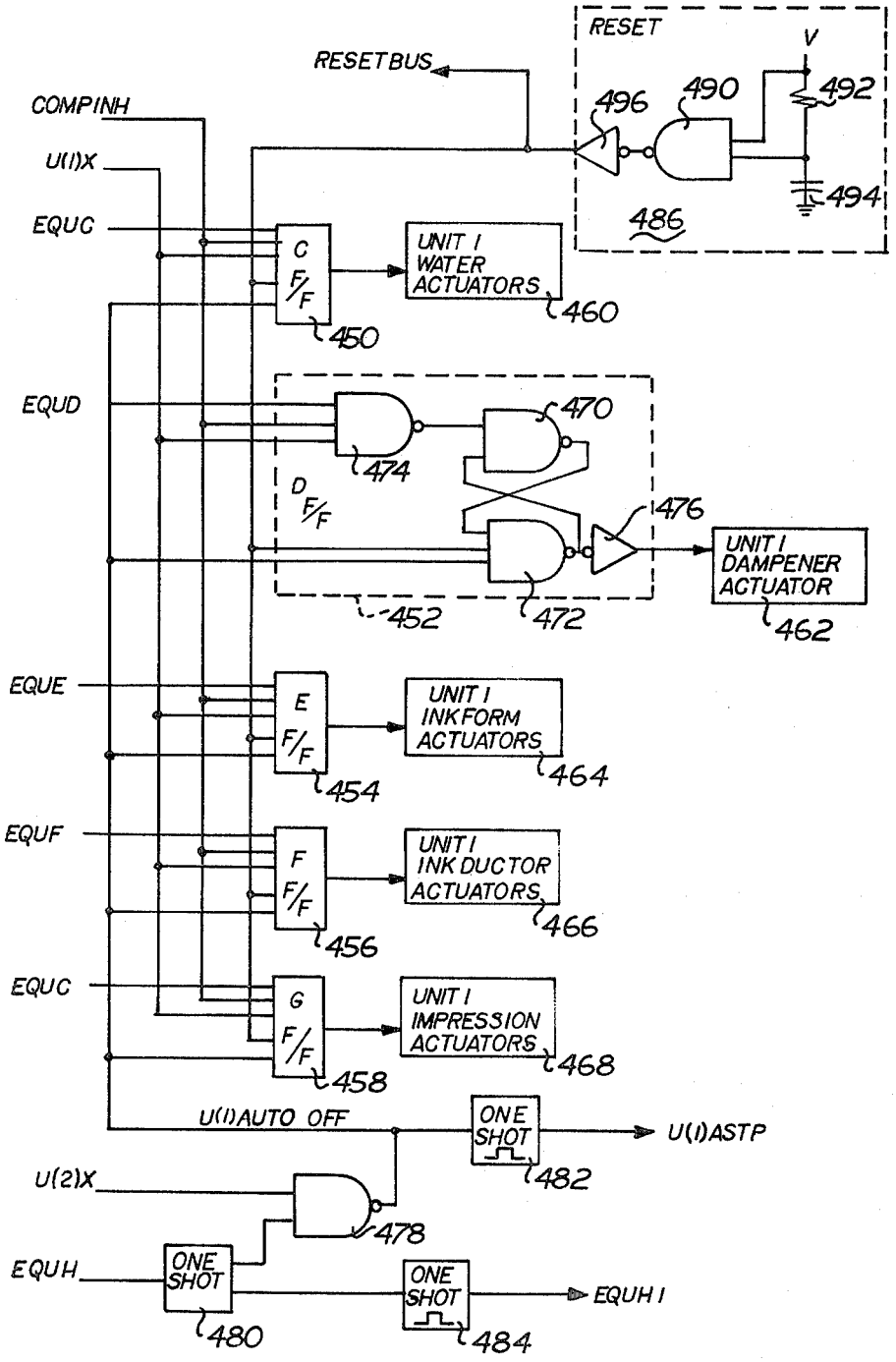

Counter select circuit 404 is also responsive to a signal which is generated whenever power is initially applied to the press. This signal ensures that up-counter 350 and down-counter 368 are reset. This is essential since, were down-counter 368 to initially indicate a value corresponding to one of the reference numbers, actuation of the corresponding press function could mistakenly result therefrom. This signal (reset bus) is generated by a circuit which is shown in FIG. 8, and will be described further with respect thereto.

It will thus be seen that, when the count generated by down-counter 168 has reached zero, the preceding run has been completed, and the sequence of events necessary to bring the alternate units on-line has also been completed. At this point, the preceding unit has been taken off-line, declutched, and braked to a stop. The down-count zero output then causes counter select circuit 404 to generate the reset pulse which will prepare the sequencer for automatically transferring operation back to the previous units upon the conclusion of the new run.

As described previously, the outputs of comparators 370–382 are directed in common to the print function control circuits associated with each of the units. Each of these print function control circuits has the form shown in FIG. 8. It will thus be appreciated that, although this print function control circuit will be described with specific reference to unit 26, the print function control circuits of the remaining units are substantially identical.

The comparator outputs EQUC-EQUG are each directed to a corresponding print function control flip-flop 450–458 which serves to control the operation of a print function in unit 26. Flip-flop 460 provides control signals to an actuator circuit 460 which controls the operation of the waterpan motors of unit 26. Flip-flop 452 supplies control signals to an actuator circuit 462 which controls the dampener (waveforms) of unit 26. Flip-flop 454 supplies control signals to an actuator circuit 464 which controls the ink forms. Flip-flop 456 supplies control signals to an actuator circuit 466 which controls the inkductor of unit 26, and flip-flop 458 supplies signals for controlling the impression actuator 468 of unit 26.

The flip-flops will either respond to, or ignore, the sequencer signals in dependence upon the value of a unit selection signal U (1) X which is supplied in common to each of the flip-flops. A comparator inhibit signal (COMPINH) is also supplied in common to each of the flip-flops for the purpose of momentarily disabling the operation thereof during those intervals when transients appearing on the sequencer comparator outputs could cause erroneous operation of the print function flip-flops. Since these transients occur concurrently with the count pulses supplied by one-shot 353 of FIG. 7, a second output of one-shot 353 is used to provide the comparator inhibit signal.

The flip-flops will all be reset at the same time, either by a reset signal generated when power is intially applied to the press, or by a U (1) Auto-Off signal generated at the conclusion of operation of unit 26.

Flip-flop 452 is shown in detail in FIG. 8. Flip-flops 450 and 454–458 are constructed similarly. Flip-flop 452 includes two cross-coupled NAND gates 470 and 472 which thus operate as a set/reset flip-flop. This flip-flop is set whenever the output of another NAND gate 474 shifts to a low logic level. This, in turn, will only occur when the three inputs to NAND gate 474 are all at a high logic level. These inputs include the output of the corresponding sequencer comparator (EQUD), a unit selection signal U (1) X and the comparator inhibit signal. Flip-flop 452 cannot respond to EQUD unless COMPINH and U (1) X are both at a high logic level. The origin and generation of the unit selection signal U (1) X will be described with respect to the mode selection circuit shown in FIG. 9. Presuming that the other units are being run and that unit 26 is now being automatically brought on-line into a printing mode, the U (1) X signal will be at a high logic level. The comparator inhibit signal also be at a high logic level and will shift to a low logic level only during the interval of the count signal generated by one-shot 353.

When the down-count supplied by down-counter 368 is equal to reference number D supplied by reference circuit 392, the EQUD output of comparator 374 will shift to a high logic level. The comparator inhibit signal will briefly be at a low logic level, after which it will return to a high logic level. At this point, (assuming U (1) X is high) all three inputs to NAND gate 474 will be at a high logic level, thus forcing the output of NAND gate 470 to a high logic level. The output of NAND gate 472 will then shift to a low logic level. This signal, as inverted by invertor 476, will produce actuation of the dampener associated with unit 1.

Flip-flop 452 will remain in the set state (and the dampener will remain actuated) until one of the two additional inputs to NAND gate 472 (reset bus or U (1) Auto-Off) falls to a low logic level. The U (1) Auto-Off signal will be generated by NAND gate 478 at the conclusion of the sequence of events which brings the alternate unit (unit 40) on-line. At that time both U (2) X and EQUH will be at a high logic level. Thus, NAND gate 478 has one input which is directed to the U (2) X selection signal generated by the mode selection circuit of FIG. 9, and has a second input derived from a one-shot 480 which is triggered by the EQUH output of the sequencer shown in FIG. 7.

Two other events must also occur at the conclusion of the run of any unit or set of units. The motor associated with the units which are coming off-line must be brought to a halt, and the mode selection circuit must be informed that the press is now operating in a new mode. The motors of the units which are coming off-line are brought to a halt through use of a U (1) ASTP signal which is generated by a one-shot 482. The mode selection circuit is informed of the change in mode through use of a signal EQUHI generated by a second one-shot 484 at the conclusion of the pulse provided by one-shot 480.

The master reset circuit 486 is also illustrated in FIG. 8. Only a single reset circuit is provided for the entire control circuitry and, although shown as being associated with the auto print function control for unit 26, in fact this reset circuit is associated with the sequencer shown in FIG. 7. The purpose of this reset circuit, as stated previously, is to reset all of the flip-flops in the control circuitry to selected states when power is initially applied to the press. This is accomplished through use of a NAND gate 490 and a RC circuit comprised of a resistor 492 and a capacitor 494. When power is initially applied to the press, the voltage across capacitor 494 will be quite low. One of the inputs to NAND gate 490 will therefore also be at a low logic level and the output of NAND gate 490 will be at a high logic level. This signal, as inverted by an inverter 496, provides the reset signal to the reset bus. Shortly after the application of power to the press, the voltage across capacitor 494 will have charged a high logic level. At this point, since both of the inputs to NAND gate 490 will be at a high logic level, the output thereof will drop to a low logic level and the output of invertor 496 will shift to a high logic level. The signal on the reset bus will remain at a high logic level thereafter.

Figure 9:
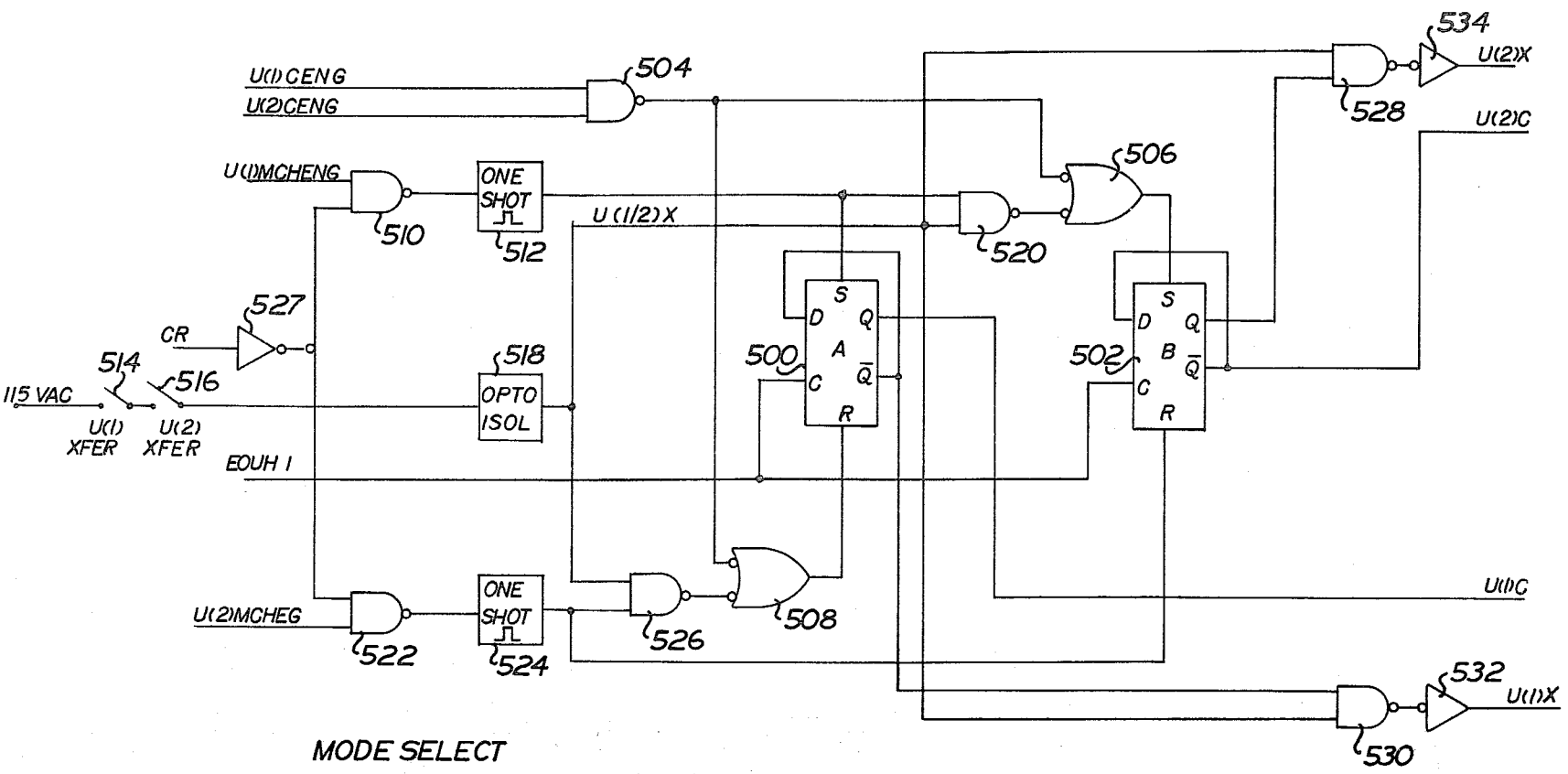

Referring now to FIG. 9, one-half of the mode selection circuit for suppling the unit selection signals is shown. The illustrated circuitry will provide unit selection signals to two of the units (units 26 and 40) which may be operated in an alternating mode. A second circuit, substantially identical with the illustrated circuit, is provided for the other two units (units 58 and 60). Thus, altough this portion of the mode selection circuit will be described with reference to units 26 and 40, it will be appreciated that a second, identical circuit is provided for supplying unit selection signals to units 58 and 60.

Two type "D"flip-flops 500 and 502 are provided for monitoring the status of units 26 and 40 respectively. These flip-flops will provide output signals which indicate which of the units has been clutched into the common drive line 90 of the press, and which unit (if any) is to respond to the print function and motor control commands supplied by the sequencer. When the press is initially started up, the status of these flip-flops will be established through use of the set and reset inputs thereto. During a run time automatic transfer between units 26 and 40, the EQUHI signal supplied by one-shot 484 (FIG. 8) (which is directed to the clock inputs of these flip-flops) will cause them to toggle from one state to the next, thereby indicating a change from one mode to the next.

The Q output of flip-flop 500 provides a signal U (1) C which indicates whether the clutch of unit 26 is engaged with the press. The $\overline{Q}$ output of flip-flop 502 provides a signal U (2) C which similarly indicates the clutch status of unit 40.

Figure 11:
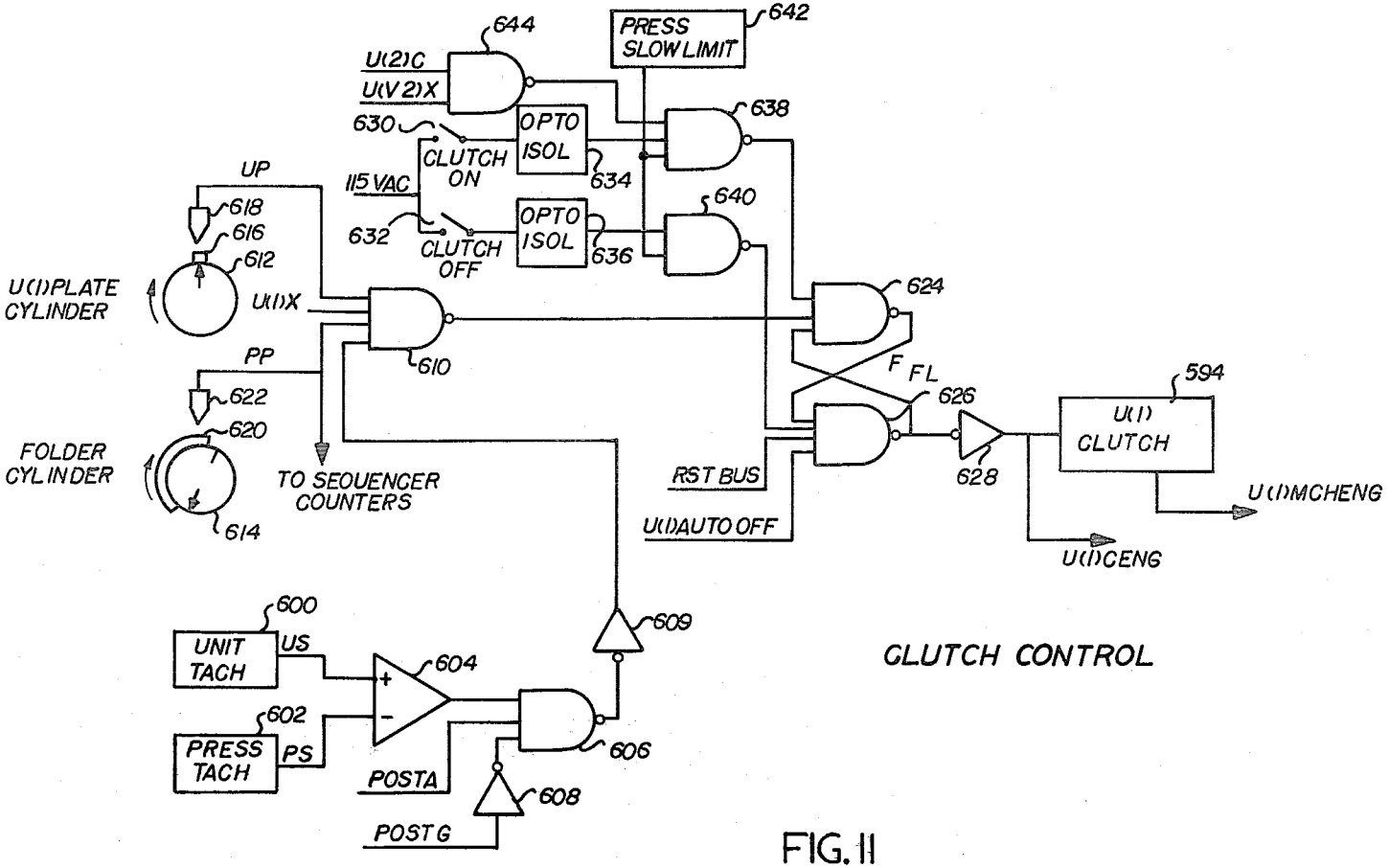

The initial status of these flip-flops is established through use of four signals which are derived from the clutch control circuitry of the units (FIG. 11). Two of these signals, U (1) CENG and U (2) CENG will have a high logic level if the clutch engagement command for the corresponding unit is at a level which will not produce engagement of the corresponding clutch. Thus, whenever both of these signals is at a high logic level (indicating that no commands have been applied to either of the units for engaging those units to the drive line of the press) the output of NAND gate 504 will shift to a low logic level, setting flip-flop 502 through NAND gate 506 and resetting flip-flop 500 through NAND gate 508. Since flip-flop 500 is now in a reset state, the Q output thereof (and U (1) C) will be at a low logic level, thus indicating that unit 26 has not been clutched into the drive line. Since flip-flop 502 has been set through NAND gate 506, the $\overline{Q}$ output thereof (and U (2) C) will also be at a low logic level, thus indicating that unit 40 has also not been clutched into the drive line of the press.

The other two signals for establishing the initial condition of flip-flops 500 and 502 are signals U (1) MCHENG and U (2) MCHENG which are derived from switches which are mechanically associated with the clutches of the respective units and which thus indicate whether or not the clutch has, in fact, engaged with the drive line of the press. As will be made clearer with reference to FIG. 11, either U (1) CENG or U (2) CENG must shift to a low logic level before the corresponding U (1) MCHENG or U (2) MCHENG will indicate that mechanical engagement has occurred. Thus, the output of NAND gate 504 will return to a high logic level, thereby removing the set and reset commands from NAND gates 502 and 500 respectively.

If the mechanical engagement signal supplied by U (1) MCHENG were then to shift to a high logic level (indicating that the unit 26 clutch has been engaged with the drive line of the press) and the press were not in a continuous run mode, then the output of NAND gate 510 will shift to a low logic level. This will cause one-shot 512 to provide a pulse which will set flip-flop 500 directly. Assuming that the transfer switches 514 and 516 of both units have been closed, the output of optical isolator 518 will be at a high logic level, thereby enabling the output of one-shot 512 to pass through NAND gate 520 and NAND gate 506 so as to also set flip-flop 502. Both flip-flops 500 and 502 will have thus been forced into a set condition. Because of this, the Q output of flip-flop 500 will be at a high logic level, indicating that unit 26 has been clutched into the press. The $\overline{Q}$ output flip-flop 502, however, will remain at a low logic level, thus continuing to indicate that unit 40 has not been clutched into the drive line.

Similarly, a NAND gate 522 will generate a low logic signal if the press is not in a continuous run mode and if the unit 40 clutch has been engaged instead of the unit 26 clutch. This low logic level will cause a one-shot 524 to produce a pulse which will reset flip-flop 500 through NAND gate 526 and NAND gate 508, while directly resetting flip-flop 502. The Q output of flip-flop 500 will therefore remain at a low logic level indicating that the unit 26 clutch has not been engaged, while the $\overline{Q}$ output of flip-flop 502 will shift to a high logic level, indicating the unit 40 has been clutched into the drive line of the press.

In this manner, the initial condition of flip-flops 500 and 502 is established. Once the press has been placed in continuous run, the input CR to inverter 527 will be at high logic level. The output of inverter 527 will thus be low, disabling NAND gates 510 and 522 and preventing the mechanical engagement signals from further effecting the states of flip-flops 500 and 502.

Flip-flops 500 and 502 also provide signals which are used to generate the unit transfer signals U(1)X and U(2)X. NAND gates 528 and 530 are provided for this purpose. Each NAND gate will provide a high logic signal whenever the other unit is clutched into the press and the transfer switches 514 and 516 are both actuated. The output of optical isolator 518 is directed to one of the inputs to NAND gates 528 and 530. The other input to NAND gate 528 is taken from the Q output of flip-flop 502, while the other input to NAND gate 530 is taken from the $\overline{Q}$ output of flip-flop 500. Thus, when unit 26 is not clutched into the drive line of the press, the U(1)C signal will be at a low logic level. Since the Q output of flip-flop 500 will be high, however, the output of NAND gate 530 will be low and the output of inverter 532 will be high. U(1)X will therefore be at a high logic level, enabling the print function controls of unit 26 to respond to the print function commands supplied by sequencer 338. Similarly, the output of NAND gate 528, as inverted by inverter 534, will cause the print function controls of unit 40 to respond to the print function commands supplied by the sequencer when unit 26 is clutched into the press and an alternating operation has been specified by the operator through his actuation of the transfer switches 514 and 516.

It will thus be seen that, when the press is being operated in an alternating fashion, only one of the unit clutch signals U(1)C or U(2)C and only one of the unit transfer signals U(1)X or U(2)X will be high at any given time. Upon the conclusion of the transfer operation from one unit to the next, the output of comparator 382 (EQUH; FIG. 7) shifts to a high logic level, causing one-shots 480 and 484 (FIG. 8) to trigger producing a pulse on the EQUH1 output of one-shot 484. This signal is directed to the mode control circuit (FIG. 9) where it is directed to the clock inputs of flip-flops 500 and 502. These flip flops are type "D" flip-flops and have their D input connected to the $\overline{Q}$ outputs so as to provide a flip-flop which toggles between set and reset conditions upon consecutive clock pulses being received on the clock input. Thus, the pulse supplied on the EQUH1 input causes flip-flops 500 and 502 to be triggered into their alternate modes wherein the unit which has just be declutched and braked to a halt (e.g. unit 26) now has the unit transfer signal (U(1)X) at a high level and the clutch indication signal (U(1)C) at a low level. Consequently, at the conclusion of the new run, this unit will again be brought on-line by the sequencer output signals.

Figure 10:
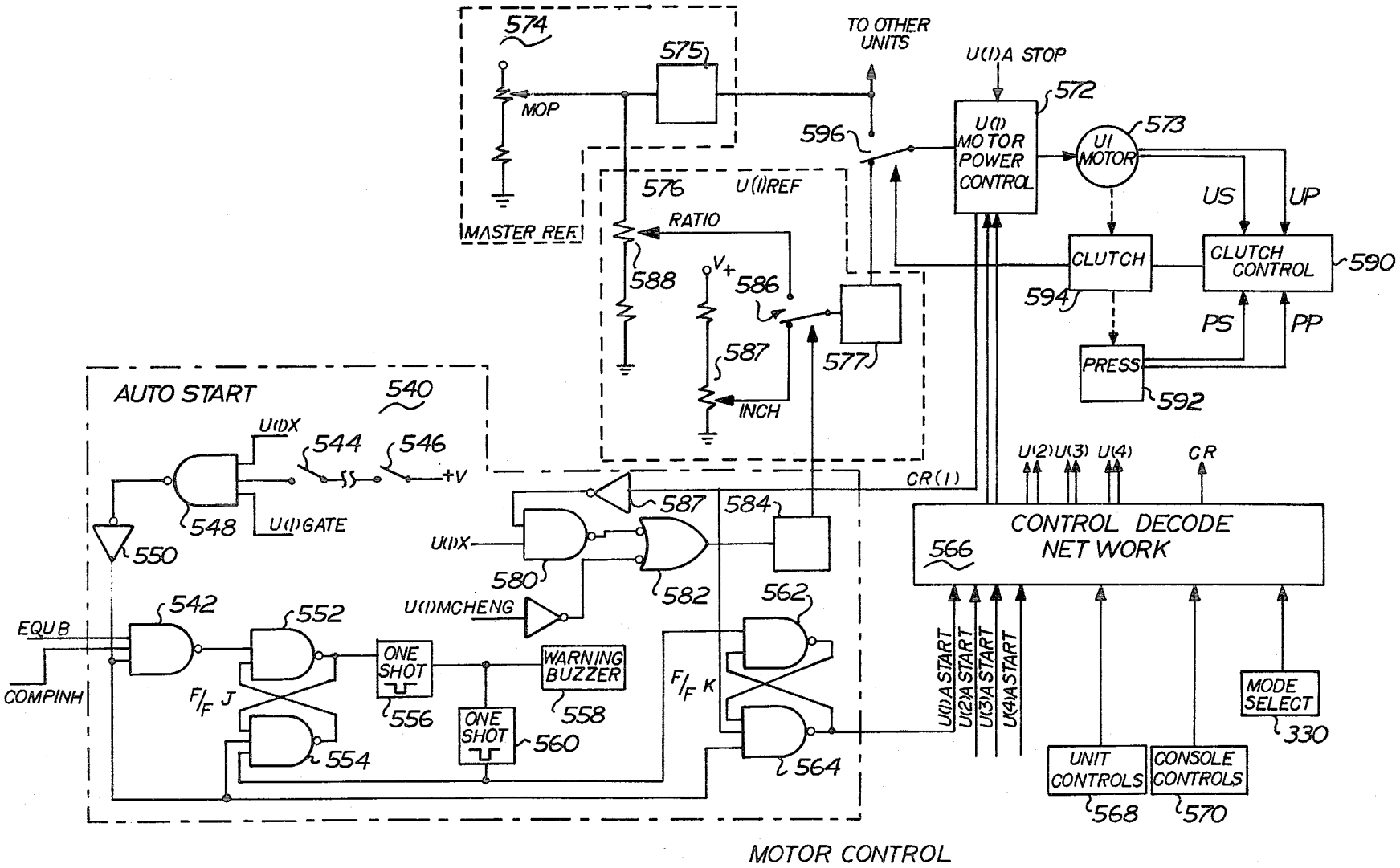

FIG. 10 illustrates a motor control circuit for automatically bringing a printing unit up to run speed and clutching the unit into the drive line at the appropriate moment. Again, for simplicity of description the circuitry associated with only a single printing unit (unit 26) is shown.

An auto start circuit 540 is provided which responds to the output (EQUB) of comparator 370 shown in FIG. 7. In this circuit, a NAND gate 542 is provided which is responsive to the EQUB output of comparator 370 (FIG. 7) for initiating the automatic start of a unit motor at the appropriate time. NAND gate 542 additionally includes two other inputs whose purpose is to disable the response of NAND gate 542 to the EQUB signal under certain circumstances.

Each of the printing units has a control switch associated with each of the printing functions thereof. Two switch positions (ON and OFF) will be provided to allow manual operation of the print functions controlled thereby. In a third position (AUTO), each of these switches will allow the automatic control circuitry to initiate the operation of the print functions associated therewith. In order for a unit to be properly prepared for automatic start, each of the switches associated with the unit must be placed in the automatic position. Consequently, a pole of each of these switches (exemplary switches are indicated by reference numbers 544 and 546) will be connected in series so that a high logic level will be presented to NAND gate 548 only upon all of the switches being placed in the AUTO position. A second input to NAND gate 548 is derived from the unit ink distribution guards and will present a high logic signal to NAND gate 548 only upon these guards being securely placed in position. The third input to NAND gate 548 is the unit selection signal U(1)X which, as previously described, will only be at a high logic level when the press is being operated in an alternating mode and unit 26 has been selected to receive the start-up instructions from the sequencer. When these three requirements are met, the output of NAND gate 548 will shift to a low logic level, thus causing the output of inverter 550 to shift to a high logic level. This will enable NAND gate 542 to respond to the EQUB signal supplied thereto by the sequencer. An additional input to NAND gate 542 (COMPINH) is provided to momentarily disable the operation of NAND gate 542 during those intervals when, as described with respect to the print function controls, transients might produce a false triggering of the auto start circuit.

When comparator 370 (FIG. 7) determfines that the number of impressions remaining to be produced in the current run is equal to reference number B, the EQUB output thereof will shift to a high logic level and, assuming that all of the prerequisites have been met, the output of NAND gate 542 will shift to a low logic level. This will initiate the start-up of the unit 26 motor. The low logic signal will set the R/S flip-flop (F/F J) created by the cross-coupling of NAND gates 552 and 554. The output of NAND gate 552 will then shift to a high logic level, causing the triggering of a one-shot 556. A warning buzzer 558 will sound during the interval of the pulse provided by one-shot 556. At the conclusion of this pulse, a second one-shot 560 will be triggered which will cause the resetting of F/F J while causing the setting of a second flip-flop (F/F K) represented by cross-coupled NAND gates 562 and 564. The output of F/F K (U(1)ASTART) is directed to a control decode network 566.

The output of inverter 550, in addition to being directed to NAND gate 542, is also directed to the reset inputs of F/F J and F/F K so as to disable the operation thereof except when the unit selection signal is at a high logic level, and the requirements referred to earlier have been met.

Control decode network 566 provides inch and slow signals to each of the four units motor power controls for controlling the operation thereof. These signals are derived from manually operable controls (unit controls 568 and console controls 570) and from the automatic start circuits provided for the various units (U(1)ASTART through U(4)ASTART). In addition, the clutch and transfer signals generated by the mode select circuit 330 are also directed to control decode network 566. Depending upon the mode in which the press is being operated, the inch and slow signals will be derived from either the automatic, or the manual control. To accomplish this function, control decode network 566 includes boolean algebra elements for logically combining the mode select signals and the manual and automatic signals so as to provide the inch and slow signals for the various units.

For the purposes of the present discussion, it will be adequate to note that the control decode network 566 will provide both inch and slow signals to a respective unit motor power control when an automatic start signal for that unit indicates that an automatic start has been initiated. Thus, when the output of F/F K (taken from the output of NAND gate 564) shifts to a low logic level, control decode network 566 will produce signals on the inch and slow inputs to the unit 26 motor power control 572 which will cause the continuous run relay thereof to pull in and cause the unit 26 motor 573 to be placed in a continuous run condition. Upon this occurring, a low logic level continuous run signal (CR(1)) will be generated which will cause F/F K to be reset. This will remove the unit 26 auto start signal from the control decode network, thus removing the inch and slow signals from the unit 26 motor power control. Since the continuous run relay of the units is a self-latching relay, unit 26 will remain in a continuous run condition until an automatic stop signal (U(1)ASTOP) has been received thereby.

The unit motor power controls of the four units may comprise conventional SCR bridge networks having the conduction angle of the SCR's controlled so as to supply controlled amounts of power to the unit motors. As with conventional systems, the level of power supplied to the motor by motor power control 572 will be controlled in accordance with a reference voltage level established by a reference signal. In the disclosed embodiment, a master reference circuit 574 is provided for supplying a voltage signal V1 to those units which are in a printing mode. Master reference circuit 574 includes a conventional motor operated potentiometer (MOP) which is controlled by the operator to establish the press speed. In addition, each unit has a separate unit reference circuit (the unit 26 reference circuit 576 is illustrated in FIG. 10) for controlling the operation of those units which have not yet been clutched into the press. Time reference circuits 575 and 577 will be included to condition the signals to be supplied to motor power control 572.

The continuous run signal supplied by motor power control 572 is directed through an inverter 578 to a NAND gate 580. When the unit selection signal U(1)X is at a high logic level and the output of inverter 578 indicates that unit 26 has been placed in a continuous run condition, the output of NAND gate 580 will shift to a low logic level which will cause the output of NAND gate 582 to shift to a high logic level. This will cause the actuation of a relay 584 which will operate a double-pole single-throw switch 586 in the unit reference circuit. In the (illustrated) unactuated mode, this switch will connect the output of the unit reference circuit to a voltage divider 587 which will provide a low magnitude voltage signal corresponding to the inch speed of the press. Once relay 584 has been actuated, however, switch 586 will shift to a second position wherein the output of the unit reference circuit is derived from a unit ratio potentiometer 588 so as to supply a signal to the unit motor power control 572 which is a known proportion of the master reference signal V1 supplied by master reference circuit 574. Because of this, upon energization, the unit motor 573 will accelerate to a speed which is close to, but slightly lower then, the speed of the press. The unit will then be clutched into the press.

A clutch control circuit 590 is supplied for determining the proper time at which to actuate the unit clutch. Clutch control circuit 590 responds to speed signals from the motor 573 and the press 592 (US and PS) and to unit position and press position signals (UP and PP) to provide a clutch energization signal at the appropriate time. An electrically controlled clutch 594 will respond by causing the unit motor 573 to be clutched into the press 592. At that time, clutch circuit 592 will also cause the actuation of a double-pole/single-throw switch 596 which will disconnect the unit reference circuit 576 from the unit power control 572 and will instead connect the master reference circuit 574 thereto. Thereafter, the unit motor will be controlled by the motor operated potentiometer (MOP) of the master reference circuit.

Referring now to FIG. 11, a more detailed diagram of the unit 26 clutch control is illustrated. A unit 26 tachometer 600 and a press tachometer 602 are used to provide voltage signals which are proportional to the speed of the unit and the press respectively. These voltage signals US and PS are compared by a comparator 604 which will provide a high logic signal output when the speed of unit 26 has reached the desired magnitude with respect to the speed of the press. A NAND gate 606 is provided for gating the comparator output signal together with two timing signals Post A and Post G (from FIG. 7) which ensure that the output of the comparator will not be gated by NAND gate 606 unless it occurs within a selected time frame. An inverter 608 is used to invert the Post G signal so as to provide an output signal which is the substantial equivalent of a "pre-G" signal, i.e., it will be at a high logic level until the down-count of the sequencer has reached reference number G. The output of NAND gate 606, as inverted by inverter 609, will shift to a high logic level when the comparator 604 indicates that the unit speed has reached the desired level. This signal is directed to another NAND gate 610.

NAND gate 610 additionally includes position signals derived from the unit 26 plate cylinder 612 and the folder cylinder 614. It will be appreciated that, since the line shaft rotates twice for every revolution of the folder cylinder, there are two possible clutch engagement positions between the units and the press. Consequently, to ensure that engagement occurs only in the proper one of these two positions, position sensors are provided for sensing the relative positions of the units and the folder. To this purpose, a tab 616 is provided on the unit plate cylinders which is sensed by a sensor 618. Additionally, folder cylinder 614 includes an extended tab 620 and a sensor 622.

Sensors 618 and 622 will provide a high logic signal output whenever the tab passes thereby, and a low logic signal otherwise. The output of the sensors is directed to NAND gate 610. (The output of folder sensor 622 is also used to provide the count signal, and is directed to NAND gate 352 of FIG. 7). Additionally directed to NAND gate 610 is the unit 26 selection signal U(1)X. NAND gate 610 will thus provide a high logic output signal unless the speed of the unit (as indicated by the output of inverter 608) and the position of the unit (as indicated by the two inputs provided by sensors 618 and 622) as well as the unit selection signal are all high. When all of these signals are high, indicating that the unit is at the proper speed and position, the output of NAND gate 610 will shift to a low logic level, causing the actuation of a flip-flop (F/F L) constructed by a cross-coupled combination of NAND gates 624 and 626. The output of F/F L (derived from the output of NAND gate 624) will shift to a low logic level when the output of NAND gate 610 shifts to a low logic level. This, in turn, will cause the output of inverter 628 to shift to a high logic level, thereby actuating the unit clutch 594. The output of inverter 628 additionally provides the U(1)CENG signal used in the mode select circuit illustrated in FIG. 9. The U(1)MCHENG mechanical engagement signal used in the mode select circuit shown in FIG. 9, is derived from the unit clutch circuit 594.

F/F L can be reset by either one of two automatically supplied signals. The first signal (RST BUS) is derived from the reset circuit 486 shown in FIG. 8. The second signal is the U(1)AUTO-OFF signal derived from NAND gate 478 of FIG. 8. This auto-off signal will cause the deactuation of the clutch at the conclusion of the unit 26 run.

Additional inputs to F/F L allow manual control of the clutch. Manually operable clutch-on and clutch-off switches 630 and 632 are provided which are isolated from the logic circuitry by optical isolators 634 and 636 respectively. When either of these switches is actuated, the output of the corresponding optical isolator will shift from a low logic level to a high logic level, thereby causing the output of the corresponding NAND gate 638 or 640 to shift to a low logic level if certain prerequisites are met. The first prerequisite is derived from a press slow limit circuit 642 which provides a high logic level output only when the speed of the press is slow enough that no danger can result from the manual engagement of the unit to the press. The second prerequisite for engagement of the clutch is derived from another NAND gate 644 which is included to ensure than an invalid operating mode is not set up by the operator. Thus, if the unit 26 and unit 40 transfer switches have both been operated, indicating an automatic alteration of modes as desired, and one of the clutches has been operated, then clearly an invalid mode would be established by the operation of the clutch of the other unit as well. The NAND gate 644 disables the manual engagement of the unit 26 clutch when the unit 40 clutch has been engaged (U(2)C) and an automatic transfer between the units is desired (U(1/2)X from FIG. 9). Consequently, the unit 26 clutch can only be manually engaged when either the unit 40 clutch has not been engaged, or when an automatic transfer between unit 26 and unit 40 is not desired.

Although the invention has been described with respect to a preferred embodiment, it will be appreciated that various rearrangements and alterations of parts may be made without departing from the spirit and scope of the invention, as defined in the following claims.

What is claimed is:

1. A web printing press comprising a plurality of printing units arranged in tandem; each of said printing units having a pair of blanket cylinders defining a printing nip therebetween, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of that unit independently of the driving of other said printing units; means for guiding the web through the nips of plural units with the blanket cylinders of at least one unit in their thrown-on position printing on the web and the blanket cylinders of another unit in their thrown-off position; and control circuit means for throwing said blanket cylinders of said another unit into printing position in timed relation to throwing said blanket cylinders of said at least one unit off while the web moves through the nips of said units, said control circuit means including means for controlling driving of the drive motor of said another unit for driving said blanket cylinders and plate cylinders of said another unit up to speed, means for controlling driving of said dampeners and inkers of said another unit to apply dampening solution and ink to the plate cylinders associated with said another unit prior to throwing said another unit on said at least one unit off.

2. A web printing press as defined in claim 1 wherein said control circuit means includes a mode select circuit which is selectively actuatable for controlling the printing units so that all units print on the web simultaneously.

3. A web printing press in accordance with claim 1 wherein each said printing units includes web attitude changing means and wherein the web, as it passes through the printing nip of one of said printing units when that unit is in a printing mode, is directed along a substantially S-shaped path through said nip by said blanket cylinders of that printing unit, and as it passes through the printing nip of that printing unit when it is in a nonprinting mode, is directed along a path normal to a plane including the axes of rotation of the blanket cylinders of that printing unit by said web attitude changing means.

4. A web printing press as defined in claim 1 wherein said control circuit means further comprises sequencer means for, at the conclusion of a printing run, automatically supplying to all of said units a sequence of commands for automatically causing said another unit to be thrown-on and said at least one unit to be thrown-off while said web is continuously moving therethrough, and means for selecting the ones of said units which are to respond to said sequence of commands while preventing the other of said units from responding to said sequence of commands.

5. A web printing press comprising a plurality of printing units arranged in tandem; each of said printing units having a pair of blanket cylinders defining a printing nip therebetween, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of that unit; means for guiding the web through the nips of plural units with the blanket cylinders of at least one unit in their thrown-on position printing on the web and the blanket cylinders of another unit in their thrown-off position; and control circuit means for throwing said blanket cylinders of said another unit into printing position in timed relation to throwing said blanket cylinders of said at least one unit off while the web moves through the nips of said units, said control circuit means including means for controlling driving of the drive motor of said another unit for driving said blanket cylinders and plate cylinders of said another unit up to speed, and means for controlling driving of said dampeners and inkers to apply dampening solution and ink to the plate cylinders associated with said another unit prior to throwing said another unit on and said at least one unit off, wherein said means for guiding the web through said nips comprises guide rolls, means for moving the guide rolls between a position in engagement with the web and a position out of engagement, and means for driving said guide rolls up to the speed of the web prior to the engagement of the guide rolls with the web.

6. A web printing press comprising at least one auxiliary unit and a plurality of printing units each adapted to be mechanically driven for selectably printing or not printing on a web passing therethrough, with each said printing unit including means defining a printing nip through which nip a web moves to receive printed matter when said printing unit is in a printing mode and through which nip said web moves without receiving printed matter when said printing unit is in a nonprinting mode, at least one of which printing units may be placed in a printing mode while at least one other of said printing units is in a nonprinting mode; means for guiding a web through the printing nips of said at least one printing unit and said at least one other printing unit; a separate drive motor for each of said printing units, each of said drive motors having a sufficient capacity to drive said at least one auxiliary unit and said at least one printing unit which is in a printing mode; a common drive shaft extending through said printing units and said at least one auxiliary unit; respective drives for transmitting torque from each of said drive motors to a corresponding one of said printing units and to said common drive shaft; each of said drives including a corresponding clutch acting between the respective motor and said common drive shaft whereby each said drive motor may be selectively engaged with said common drive shaft for driving said at least one auxiliary unit and the printing unit with which that drive motor is associated and selectively disengaged from said common drive shaft for selective driving of the printing unit with which that motor is associated independently of said auxiliary unit.

7. A web printing press in accordance with claim 6 further including means for selectively shifting said at least one printing unit from a printing mode to a nonprinting mode and simultaneously shifting said at least one other printing unit from a nonprinting mode to a printing mode.

8. A web printing press in accordance with claim 7 further including control means for selectively shifting one of said printing units from a printing mode to a nonprinting mode and another of said printing units from a nonprinting mode to a printing mode while said web is moving continuously therethrough.

9. A web printing press in accordance with claim 6 wherein said clutches each comprise a single position clutch having a first shaft mounted part secured to the common drive shaft for rotation therewith; a second clutch part driven by the corresponding said motor, and means including an axially movable member movable between a first engaged position for locking said first and second portions together in a single known relative position, and a second disengaged position wherein said first and second portions are rotatable one relative to the other.

10. A web printing press in accordance with claim 9 wherein each said drive includes an input shaft and an output shaft on opposite sides of said common drive shaft, each of said input and output shafts having a pinion gear mounted thereon and, a ring gear coaxially mounted on said common drive shaft for independent rotation with respect thereto and in mesh with each of said pinion gears.

11. A web printing press comprising at least one auxiliary unit and a plurality of printing units each adapted to be mechanically driven for selectably printing or not printing on a web passing therethrough, with each said printing unit including means defining a printing nip through which nip a web moves to receive printed matter when said printing unit is in a printing mode and through which nip said web moves without receiving printed matter when said printing unit is in a nonprinting mode, at least one of which printing units may be placed in a printing mode while at least one other of said printing units is in a nonprinting mode; means for guiding a web through the printing nips of said at least one printing unit and said at least one other printing unit; a separate drive motor for each of said printing units, each of said drive motors having a sufficient capacity to drive said at least one auxiliary unit and said at least one printing unit which is in a printing mode; a common drive shaft extending through said printing units and said at least one auxiliary unit; respective drives for transmitting torque from each of said drive motors to a corresponding one of said printing units and to said common drive shaft; each of said drives including a corresponding clutch acting between the respective motor and said common drive shaft whereby each said drive motor may be selectively engaged with said common drive shaft for driving said at least one auxiliary unit and the printing unit with which that drive motor is associated and selectively disengaged from said common drive shaft for selective driving of the printing unit with which that motor is associated independently of said auxiliary unit; and wherein each of said printing units includes means for changing the attitude of the web, when passing through said printing nip, from a first attitude when the printing unit is in a printing mode to a second attitude when the printing unit is in a nonprinting mode, said attitude changing means including a pair of web engaging rolls, one of said rolls being adjacent to and in advance of said printing nip with respect to the direction of web passage and the second of said rolls being adjacent to and after said printing nip with respect to the direction of web passage, and means for moving each of said web engaging rolls between first and second positions respectively producing said first and second web attitudes in which the first position of each of said web engaging rolls is out of contact with said web and the second position of said web engaging rolls is in contact with said web.

12. A web printing press in accordance with claim 11, said printing unit each including means for matching the speed of the surface of the associated said web engaging rolls to the linear speed of said web prior to movement of said rolls from said first position to said second position.

13. A web printing press in accordance with claim 12 in which the speed matching means includes a part rotatable with a printing cylinder of the corresponding unit and a friction wheel for each web engaging roll with each friction wheel in driven frictional engagement with said part rotatable with a printing cylinder, and positioned for frictional driving engagement with a corresponding said web engaging roll when the corresponding said printing unit is in a nonprinting mode, and said web engaging roll is out of contact with said web.

14. A web printing press comprising a plurality of printing units arranged in tandem; each of said printing units having a pair of blanket cylinders defining a printing nip therebetween, at least one speed matching friction wheel rotatable with said blanket cylinders, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of that unit; means for guiding the web through the nips of plural units with the blanket cylinders of at least one unit in their thrown-on position printing on the web and the blanket cylinders of another unit in their thrown-off position; control circuit means for throwing said blanket cylinders of said another unit into printing position in timed relation to throwing said blanket cylinders of said at least one unit off while the web moves through the nips of said units, said control circuit means including means for controlling driving of said drive motor of said another unit for driving said blanket cylinders and plate cylinders of said another unit up to speed, means for controlling driving of said dampeners and inkers to apply dampening solution and ink to the plate cylinders associated with said another unit prior to throwing said at least one unit off and said another unit on; and with each of said printing units including a pair of web engaging guide rolls for changing the attitude of said web, one of said web engaging guide rolls being adjacent to and in advance of the associated said printing nip with respect to the direction of web passage and the other of said web engaging rolls being adjacent to and after the associated said printing nip with respect to the direction of web passage, and means for selectively moving the web engaging roll in advance of the associated said printing nip between a second position in engagement with one surface of said web, and a first position out of contact with said web and in frictional driven engagement with at least one of said speed matching friction wheels, and for also selectively moving the other of said web engaging rolls located after said printing nip between a second position in engagement with the opposite surface of said web, and a first position out of contact with said web and in frictional driven engagement with at least one of said speed matching friction wheels.

15. A web printing press comprising a plurality of printing units arranged in tandem and at least one auxiliary unit; each of said printing units having a pair of blanket cylinders defining a printing nip therebetween, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of that unit; means for guiding the web through the nips of plural units with the blanket cylinders of at least one unit in their thrown-on position printing on the web and the blanket cylinders of another unit in their thrown-off position; a common drive shaft extending through said printing units and said at least one auxiliary unit; respective drives for each transmitting torque from the corresponding said drive motor to the blanket cylinders and plate cylinders of the associated unit, said drives each including a clutch acting between said common drive shaft and the motor associated with the corresponding unit whereby each of said drive motors may be selectively engaged with said common drive shaft for driving said at least one auxiliary unit and a printing unit simultaneously; and control circuit means for throwing said blanket cylinders of said another unit into printing position in timed relation to throwing said blanket cylinders of said at least one unit off while the web moves through the nips of said units, said control circuit means including means for controlling driving of said dampeners and inkers to apply dampening solution and ink to the plate cylinder associated with said another unit prior to throwing said another unit on and said at least one unit off, and means for controlling said drive motor of said another unit including means for energizing said drive motor of said another unit and for bringing said unit up to a known fraction of the speed of said common drive shaft and means for then energizing the clutch associated with said another unit.

16. A web printing press as defined in claim 15 wherein said means for energizing the clutch associated with said another unit comprises means for sensing the relative speed and position of said drive shaft and the drive motor associated with said another unit and means for causing said energization of said clutch associated with said another unit at a selected said relative speed and position.

17. A web printing press comprising a plurality of printing units arranged in tandem and at least one auxiliary unit; each of said printing units having a pair of blanket cylinders defining a printing nip therebetween, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of that unit; means for guiding the web through the nips of plural units with the blanket cylinders of at least one unit in their thrown-on position printing on the web and the blanket cylinders of another unit in their thrown-off position; a common drive shaft extending through said printing units and said at least one auxiliary unit; respective drives for each transmitting torque from the corresponding said drive motor to the blanket cylinders and plate cylinders of the associated unit, said drives each including a clutch acting between said common drive shaft and the motor associated with the corresponding unit whereby each of said drive motors may be selectively engaged with said common drive shaft for driving said at least one auxiliary unit and a printing unit simultaneously; and control circuit means for throwing said blanket cylinders of said another unit into printing position in timed relation to throwing said blanket cylinders of said at least one unit off while the web moves through the nips of said units, said control circuit means including means for controlling driving of said drive motor of said another unit for driving said blanket cylinders and plate cylinders of said another unit up to speed and for then engaging said drive motor with said commond drive shaft, means for controlling driving of said dampeners and inkers to apply dampening solution and ink to the plate cylinders associated with said another unit prior to throwing said another unit on and said at least one unit off, master reference means for jointly controlling the motors associated with those of said units which are engaged with said common drive shaft, and unit reference means associated with each of said printing units for each controlling the operation of the corresponding said drive motor when said drive motor has been energized but is not engaged with said common drive shaft.

18. A web printing press comprising a plurality of printing units arranged in tandem and at least one auxiliary unit; each of said printing units having a pair of blanket cylinders defining a printing nip therebetween, a plate cylinder associated with each blanket cylinder so as to define an offset printing arrangement, means for moving said blanket cylinders between thrown-on and thrown-off positions for printing and not printing on a web moving through the nip, dampeners for applying dampening solution to plates on said plate cylinders, inkers for applying ink to plates on said plate cylinders, and a drive motor for driving at least the blanket and plate cylinders of the respective unit independently of the driving of other said printing units; means for guiding the web through the nips of plural units with the blanket cylinders of at least one unit in their thrown-on position printing on the web and the blanket cylinders of another unit in their thrown-off position; a common drive shaft extending through said printing units and said at least one auxiliary unit; respective drives for each transmitting torque from the corresponding said drive motor to the blanket cylinders and plate cylinders of the associated unit, said drives each including a clutch acting between said common drive shaft and respective motor whereby each of said drive motors may be selectively engaged with said common drive shaft for driving said at least one auxiliary unit and a printing unit simultaneously; and control circuit means for throwing said blanket cylinders of said another unit into printing position in timed relation to throwing said blanket cylinders of said at least one unit off while the web moves through the nips of said units, said control circuit means including means for controlling driving of the drive motor of said another unit for driving said blanket cylinders and plate cylinders of said another unit up to speed and for then engaging the associated said clutch to engage said drive motor with said common drive shaft, and means for controlling driving of said dampeners and inkers of said another unit to apply dampening solution and ink to the plate cylinders associated with said another unit prior to throwing said another unit on and said at least one unit off.

* * * * *